US012458833B2

(12) United States Patent
Abbott et al.

(10) Patent No.: US 12,458,833 B2
(45) Date of Patent: Nov. 4, 2025

(54) EXERCISE EQUIPMENT CLAMP AND HANDLES

(71) Applicant: Jayflex LLC, Springville, UT (US)

(72) Inventors: Ethan Abbott, Saratoga Springs, UT (US); Ryker Haddock, Provo, UT (US); Jonothan D. DiPeri, Springville, UT (US); Connor R. Wright, Springville, UT (US); Christopher R. Huntington, South Jordan, UT (US); Douglas M. Hintze, Saratoga Springs, UT (US)

(73) Assignee: Jayflex LLC, Springville, UT (US)

( * ) Notice: Subject to any disclaimer, the term of this patent is extended or adjusted under 35 U.S.C. 154(b) by 0 days.

(21) Appl. No.: 18/884,760

(22) Filed: Sep. 13, 2024

(65) Prior Publication Data

US 2025/0001235 A1 Jan. 2, 2025

Related U.S. Application Data

(63) Continuation-in-part of application No. 18/240,609, filed on Aug. 31, 2023, which is a continuation of (Continued)

(51) Int. Cl.
*A63B 21/072* (2006.01)
*A63B 21/00* (2006.01)

(52) U.S. Cl.
CPC ..... *A63B 21/0722* (2015.10); *A63B 21/0724* (2013.01); *A63B 21/0726* (2013.01); *A63B 21/0728* (2013.01); *A63B 21/15* (2013.01)

(58) Field of Classification Search
CPC ..... A63B 21/0722; A63B 21/0724; A63B 21/0726; A63B 21/0728; A63B 21/4035;

(Continued)

(56) References Cited

U.S. PATENT DOCUMENTS 1,366,200 A 1/1921 Matysek
3,716,650 A * 2/1973 de Mecquenem ..... H02G 7/12 24/135 R (Continued)

FOREIGN PATENT DOCUMENTS

KR 10-2010-0010113 A 2/2010
WO 2022/244277 A1 11/2022

OTHER PUBLICATIONS

Amazon.com "keehui Heavy Duty 316SS Boat Hand Rail Fitting-Polished 90 Degree T/Tee Hinged/Split Fitting 1" Tube", date first available May 19, 2019, retrieved from the Internet on Jun. 16, 2025 (Year: 2019).*

(Continued)

*Primary Examiner* — Loan B Jimenez
*Assistant Examiner* — Kathleen M Fisk
(74) *Attorney, Agent, or Firm* — Young Basile Hanlon & MacFarlane, P.C.

(57) ABSTRACT

An exercise system comprising a clamp for securing or engaging a dumbbell. The system may include a cable connector and the clamp. The cable connector includes an aperture that is configured to engage a corresponding attachment of a cable. The clamp has an open configuration and a closed configuration. The clamp defines a first cavity and a second cavity. When the clamp is in the open configuration, the first cavity is configured to receive a portion of exercise equipment and the second cavity is configured to receive a portion of the cable connector. When the clamp is in a closed configuration, the clamp is configured to secure the cable connector relative to the exercise equipment.

20 Claims, 17 Drawing Sheets

Related U.S. Application Data application No. 17/736,838, filed on May 4, 2022, now Pat. No. 11,752,385.

(60) Provisional application No. 63/184,681, filed on May 5, 2021.

(58) Field of Classification Search
CPC ... A63B 2244/09; A63B 21/15; A63B 21/151; A63B 21/152; A63B 21/154
See application file for complete search history.

(56) References Cited

U.S. PATENT DOCUMENTS

| | | | | |
|---|---|---|---|---|
| 4,216,959 | A * | 8/1980 | Niles | A63B 21/0783 24/299 |
| 4,564,194 | A * | 1/1986 | Dawson | A63B 21/0626 482/102 |
| 5,496,243 | A | 3/1996 | Allen | |
| 5,989,166 | A * | 11/1999 | Capizzo | A63B 21/0783 482/93 |
| 6,893,381 | B2 * | 5/2005 | Slawinski | A63B 21/0783 482/4 |
| 8,267,841 | B1 | 9/2012 | Allison et al. | |
| 9,327,160 | B2 * | 5/2016 | Tauriainen | A63B 21/0783 |
| 9,630,045 | B1 | 4/2017 | Martin, Sr. | |
| 9,731,159 | B2 * | 8/2017 | Reynolds | A63B 21/4035 |
| 10,086,225 | B2 * | 10/2018 | Sheppard | A63B 21/0728 |
| D881,302 | S | 4/2020 | Greene | |
| 10,799,753 | B2 | 10/2020 | Koenig | |
| 11,179,588 | B2 | 11/2021 | McCall | |
| 11,324,988 | B1 | 5/2022 | Reed | |
| 11,331,530 | B2 * | 5/2022 | Amyan | A63B 21/0722 |
| 11,745,047 | B2 * | 9/2023 | Vaudreuil | A63B 21/0783 482/108 |
| 11,752,385 | B2 | 9/2023 | Abbott et al. | |
| 12,179,054 | B2 * | 12/2024 | Breaux | A63B 71/0619 |
| 2011/0173778 | A1 * | 7/2011 | Wales | B25G 3/20 16/426 |
| 2011/0177922 | A1 * | 7/2011 | Selinger | A63B 21/0724 482/107 |
| 2012/0172182 | A1 | 7/2012 | Leier et al. | |
| 2012/0252641 | A1 | 10/2012 | Odneal et al. | |
| 2013/0210589 | A1 | 8/2013 | Thompson et al. | |
| 2014/0018214 | A1 | 1/2014 | Jordan | |
| 2014/0024506 | A1 * | 1/2014 | Vixathep | A63B 21/0726 482/108 |
| 2016/0096063 | A1 | 4/2016 | Reynolds et al. | |
| 2017/0266479 | A1 | 9/2017 | McCall | |
| 2021/0402241 | A1 * | 12/2021 | Carter | A63B 23/1227 |
| 2022/0339487 | A1 * | 10/2022 | Dickstein | A63B 21/0722 |
| 2022/0355153 | A1 | 11/2022 | Abbott et al. | |
| 2025/0001235 | A1 * | 1/2025 | Abbott | A63B 21/4035 |

OTHER PUBLICATIONS

"Dumbbell Barbell Converter Set, Transform Dumbbells Into a Complete Home Gym—Versatile Adjustable Weight for Full Body Workouts", dated Mar. 23, 2024, Found online on May 21, 2024, https://tinyurl.com/mv5e7854, pp. 5.

"Jayflex Hyperbell Dumbbell Converter—Convert Dumbbells to Barbell Set and Kettlebell for Home Fitness—Adjustable & Up to 200 lb Capacity Weight Barbell for Weight Lifting", dated Mar. 22, 2023, Found online on May 21, 2024, https://tinyurl.com/wxmwpkdn, pp. 3.

"Jayflex Hyperbell Dumbbell Converter—Convert Dumbbells to Barbell Set and Kettlebell for Home Fitness—Adjustable & Up to 200 lb Capacity Weight Barbell for Weight Lifting", dated Aug. 28, 2023, Found online May 21, 2024 , https://www.amazon.com/Jayflex-Hyperbell-Dumbbell-Converter-Kettlebell/dp/BOCGTJW8W1, pp. 3.

Hyperbell Bar by Jayflex dated Nov. 8, 2021. Found online May 21, 2024, <https://jayflexfithess.com/products/bar-hyperbell, > pp. 4.

OJEXA Dumbbell Convert to Barbell set—Adjustable weights & UP to 200 lb Capacity Weight Barbell—Steel Clamp—Barbell—Street Clamp—Barbell Dumbbells Converter for Home Gym—Weight lifting for full body workouts, dated Nov. 30, 2023, Found online, May 21, 2024, https://tinyurl.com/mrc5n6ts, pp. 3.

* cited by examiner

EXERCISE EQUIPMENT CLAMP AND HANDLES

CROSS-REFERENCE TO RELATED APPLICATION(S)

This application is a continuation-in-part of U.S. patent application Ser. No. 18/240,609, filed Aug. 31, 2023, which is a continuation of U.S. patent application Ser. No. 17/736,838, filed May 4, 2022, which claims the benefit of U.S. Provisional Patent Application No. 63/184,681, filed May 5, 2021, each application of which is hereby incorporated by reference.

TECHNICAL FIELD

This disclosure relates generally to exercise equipment and exercise systems, and more particularly to resistance exercise equipment and adaptors therefor.

BACKGROUND

Resistance exercise equipment can get quite expensive. In particular, many users want to use dumbbells, kettlebells, barbells, etc. in order to perform many different exercises. These exercises may have the same total amount of weight but work the user's muscles very differently. As examples, barbells are used for high resistance, dumbbells are used for isolation exercises and kettlebells are used for movement exercise. These different exercises lead to very different results and a user may wish to perform all types to maximize benefits.

For example, doing a dumbbell bench press using 50 pound dumbbells (100 pounds total) is very different than a bench press using a 100 pound barbell and both of those are different than a kettle bell press using two 50 pound kettlebells. Thus, if a user wants to perform all of these exercises, that user must purchase dumbbells, kettlebells and barbell plates, all of the same weight. This can get expensive and takes far more storage room.

Accordingly, there is a need in the art for exercise equipment that allows a user to switch between dumbbells, kettlebells and barbells.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One aspect of the disclosure is a clamp for exercise equipment or that forms part of an exercise system. The clamp includes a body. The body is configured to receive a portion of a piece of exercise equipment. The body includes a first portion, a second portion and a hinge connecting the first portion and the second portion. The clamp also includes a neck. The neck is cylindrical in shape. The neck includes a first portion attached to the first portion of the body and a second portion attached to the second portion of the body. The clamp further includes a securing mechanism, the securing mechanism configured to secure the first portion of the neck to the second portion of the neck. The neck is configured to secure to an external handle when secured by the securing mechanism.

Another aspect of the disclosure is a clamp for exercise equipment. The clamp includes a body. The body is configured to receive a dumbbell handle. The body includes a first portion a second portion and a hinge connecting the first portion and the second portion. The clamp also includes a grip within the body, where the grip is configured to secure the dumbbell handle. The clamp further includes a neck. The neck is cylindrical in shape. The neck includes a first portion attached to the first portion of the body a second portion attached to the second portion of the body and one or more protrusions. The clamp additionally includes a collar, the collar configured to secure the first portion of the neck to the second portion of the neck by threading onto the neck. The neck is configured to secure to an external handle when secured by the collar. One or more indentations in the external handle are configured to mate with the one or more protrusions in the neck.

Another aspect of the disclosure is a clamp for exercise equipment. The clamp includes a body. The body is configured to receive a dumbbell handle. The body includes a first portion, a second portion and a hinge connecting the first portion and the second portion. The clamp also includes a grip within the body, where the grip is configured to secure the dumbbell handle. The clamp further includes a neck, where the neck is cylindrical in shape. The neck includes a first portion attached to the first portion of the body a second portion attached to the second portion of the body and four protrusions spaced equidistant from one another. The clamp additionally includes a collar, the collar configured to secure the first portion of the neck to the second portion of the neck by threading onto the neck. The clamp further includes a kettlebell handle. The kettlebell handle includes four indentations configured to mate with the four protrusions in the neck. The neck is configured to secure to the kettlebell handle when secured by the collar.

Another aspect of the disclosure is an exercise equipment adaptor. The exercise equipment adaptor includes a cable connector and a clamp. The cable connector includes an aperture that is configured to engage a corresponding attachment of a cable. The clamp has an open configuration and a closed configuration. The clamp defines a first cavity that extends along a first axis and defines a second cavity that extends along a second axis. The first axis is perpendicular to the first axis. When the clamp is in the open configuration, the first cavity is configured to receive a portion of exercise equipment and the second cavity is configured to receive a portion of the cable connector. When the clamp is in the closed configuration, the clamp is configured to secure the cable connector relative to the exercise equipment.

Another aspect of the disclosure is an exercise equipment clamp. The exercise equipment clamp includes a first clamshell portion, a second clamshell portion, and a hingle. The first clamshell portion defines a first portion of a first cavity and a first portion of a second cavity. The second clamshell portion defines a second portion of the first cavity and a second portion of the second cavity. The hinge ratably connects a first end of the first clamshell portion to a first end of the second clamshell portion. A fastener is configured to selectively connect a second end of the first clamshell portion to a second end of the second clamshell portion to secure a portion of exercise equipment within the first cavity, and to secure a portion of a cable connector within the second cavity that includes an aperture that is connectable to a corresponding attachment of a cable.

Another aspect of the disclosure is an adaptor for exercise equipment. The adaptor includes a clamp and a cable connector. The clamp includes a first portion that has a first body cavity and a first neck cavity. The clamp also includes a second portion that has a second body cavity and a second neck cavity. The clamp also includes a hinge that rotatably couples the first portion and the second portion to define an open configuration and a closed configuration. The cable connector includes an aperture. The aperture is configured to engage with a corresponding attachment of a cable. When the clamp is in the open configuration, at least one of the first body cavity or the second body cavity is configured to receive a portion of exercise equipment. Furthermore, when the clamp is in the open configuration, at least one of the first neck cavity or the second neck cavity is configured to receive a portion of the cable connector. When the clamp is in the closed configuration, the first body cavity and the second body cavity are configured to cooperatively extend around the portion of the exercise equipment. Furthermore, when the clamp is in the closed configuration, the first neck cavity and the second neck cavity are configured to cooperatively extend around the portion of the cable connector to secure the exercise equipment relative to the cable connector.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
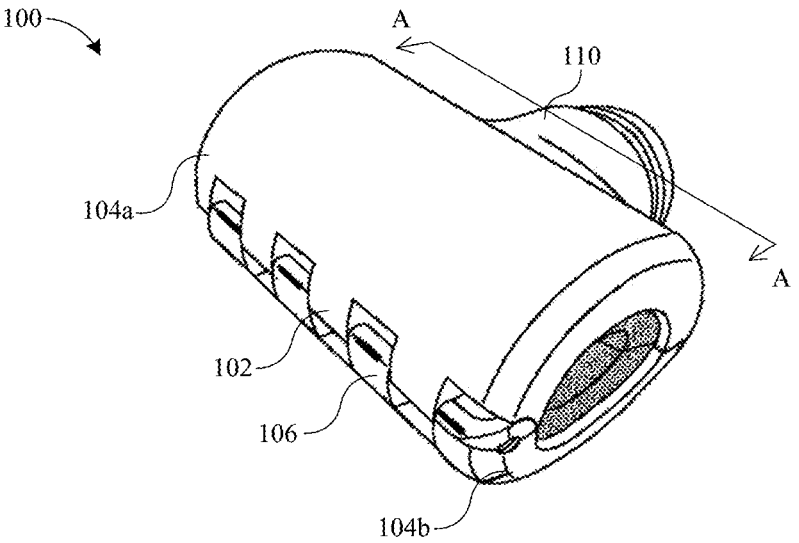
FIG. 1A is a perspective view illustration of an example of a clamp in a closed configuration.
Figure 1B:
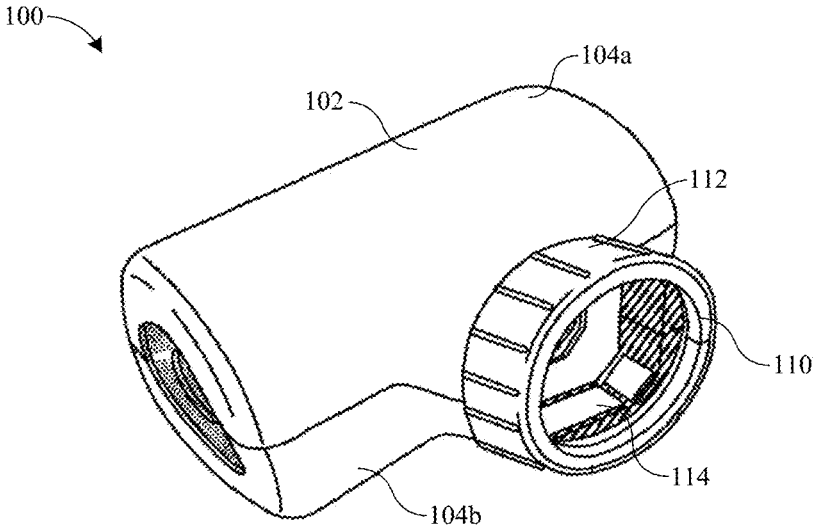
FIG. 1B is another perspective view illustration of the clamp of FIG. 1A in the closed configuration.
Figure 1C:
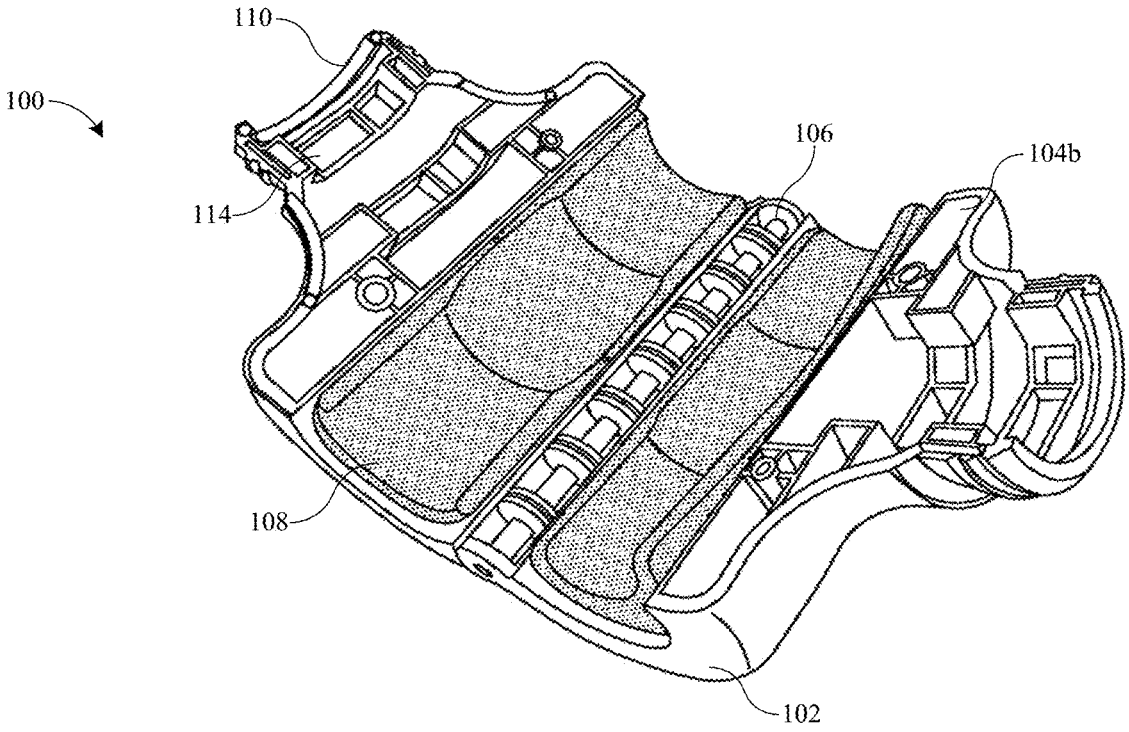
FIG. 1C is a perspective view illustration of the clamp of FIG. 1A in an open configuration.
Figure 1D:
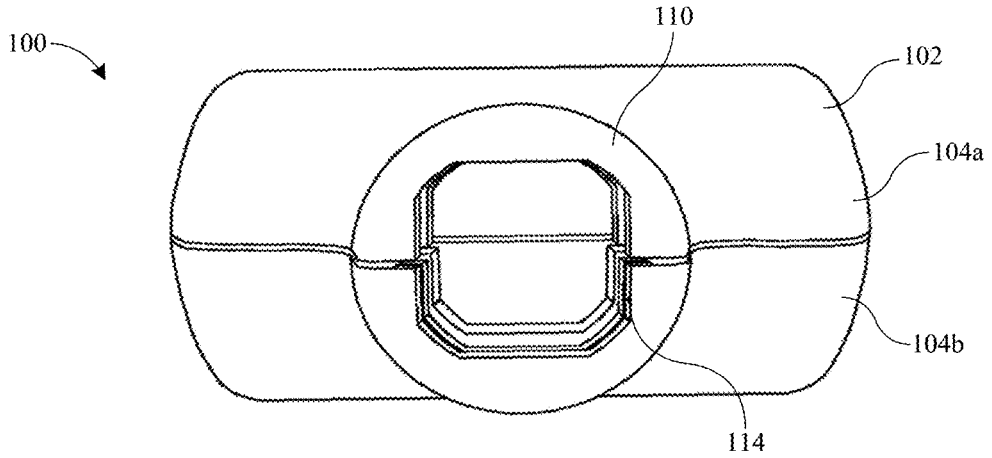
FIG. 1D is a cross-section view of the clamp in the closed configuration taken along the line A-A of FIG. 1A.
Figure 1E:
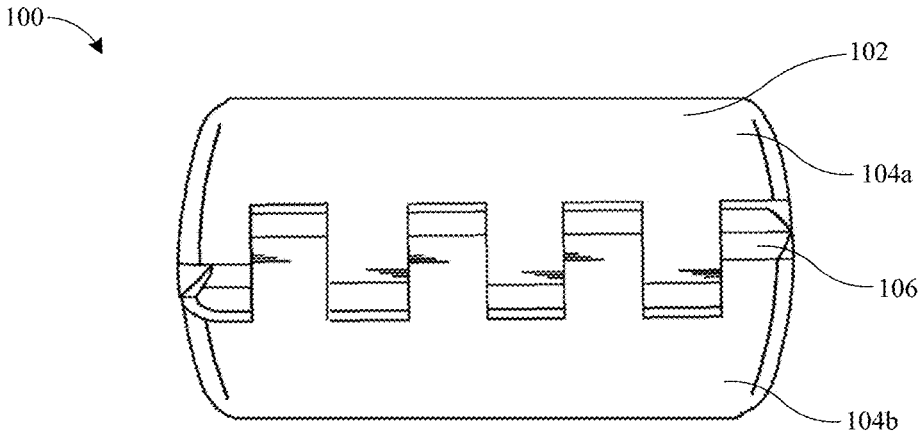
FIG. 1E is a rear view illustration of the clamp of FIG. 1A in the closed configuration.

FIGS. 1A, 1B, 1C, 1D, and 1E (collectively "FIG. 1") illustrate an example of a clamp 100 for exercise equipment. FIG. 1A illustrates a perspective view of an example of an open instance of the clamp 100; FIG. 1B illustrates an alternative perspective view of an example of an open instance of the clamp 100; FIG. 1C illustrates an example of a closed instance of the clamp 100; FIG. 1D illustrates a cross-section of the clamp 100 for exercise equipment along the line A-A of FIG. 1A; and FIG. 1E illustrates a rear view of an example of a closed clamp. The clamp 100 allows for attaching exercise handles (such as a kettlebell handle or barbell) to exercise equipment. I.e., the clamp 100 holds to a portion of a piece of exercise equipment (such as a dumbbell handle) and allows for attachment of a different type of exercise handle. This allows a user to use the same exercise equipment for different purposes, which means the cost of building a home gym can be greatly reduced.

FIG. 1 shows that the clamp 100 includes a body 102. The body 102 is configured to receive a portion of a piece of exercise equipment. Normally the portion of exercise equipment will be the handle, but that is not required. This is because the handle of the exercise equipment is typically smooth and even. I.e., the handle of the exercise equipment is easy to attach. However, any portion of the exercise equipment which fits into the body 102 can be attached. This may be helpful in other types of equipment, such as resistance bands. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

FIG. 1 also shows that the body 102 can include a first portion 104*a* and a second portion 104*b*. The first portion 104*a* and second portion 104*b* together surround the received portion of the exercise equipment. That is, the first portion 104*a* and the second portion 104*b* together form a closed loop into which the received portion of the exercise equipment is configured to be placed. This prevents the received portion of the exercise equipment from escaping form the body 102 during exercise. The first portion 104*a* and the second portion 104*b* can be identical to one another (except for the threads, which need to be different), which allows for ease of manufacture.

FIG. 1 further shows that the body 102 can include a hinge 106. The hinge 106 connects the first portion 104*a* and the second portion 104*b*. A hinge is a mechanical bearing that connects two solid objects, typically allowing only a limited angle of rotation between them. Two objects connected by a hinge rotate relative to each other about a fixed axis of rotation: all other translations or rotations being prevented, and thus a hinge has one degree of freedom. Any type of hinge 106 is contemplated herein; however, the easiest type of hinge (for both manufacturing and ease of use) is a barrel hinge. A barrel hinge consists of a sectional barrel (the knuckle) secured by a pivot. A barrel is simply a hollow cylinder. Thus, the hinge 106 secures the first portion 104*a* and the second portion 104*b* and allows motion of the first portion 104*a* and the second portion 104*b* relative to one another, around a fixed axis of rotation.

FIG. 1 additionally shows that the body 102 can include a grip 108. The grip 108 is a flexible material which secures the received portion of the exercise equipment. For example, the grip 108 can include foam, or any other similar material such as rubber, vinyl, silicone, PVC, TPE, or other types of polymers. By using a flexible material for the grip 108, the received portion of the exercise equipment doesn't rotate or move laterally within the body 102. I.e., it prevents movement of the received portion of the exercise equipment within the body 102. In addition, the grip 108 allows for receiving exercise equipment of different sizes. For example, the grip 108 will accept dumbbell handles that are 3.0 inches or greater in length (most dumbbell handles are approximately 6.0 inches long). In addition, the diameter of the dumbbell handle needs to be between 0.75 and 2.0 inches at its thickest point. The grip 108 will contour to both straight and curved dumbbell handles. Some types of dumbbell which can fit within the grip 108 include hex dumbbells, Bowflex SelectTech Adjustable Dumbbells (552 and 1090), CORE Fitness, Peloton, JaxJox, MX Select, Weider, and many others.

FIG. 1 moreover shows that the body 102 can include a neck 110. The neck 110 is cylindrical in shape. The neck 110 is divided into two pieces, one on the first portion 104*a* and the second portion 104*b*. I.e., when the first portion 104*a* and the second portion 104*b* are closed around the received portion of the exercise equipment, the neck 110 is a cylinder.

FIG. 1 also shows that the clamp 100 can include a collar 112. The collar 112 secures to the neck 110. When the collar 112 is placed on the neck 110, the neck is held in place, meaning that the first portion 104*a* and the second portion 104*b* cannot move relative to one another, which in turn keeps the received portion of the excise equipment within the body 102. The collar 112 can attach to the neck 110 by threading onto the neck 110, snapping onto the neck 110 or through any other desired attachment method.

FIG. 1 further shows that the neck 110 includes one or more protrusions 114. The one or more protrusions 114 allow for mating of an external handle. The protrusions 114 serve at least two functions. They stop the clamp 100 from being removed from the external handle until desired. In addition, they stop the clamp 100 from rotating relative to the external handle. Either one (separation of the external handle or rotation of the external handle) could lead to problems, including injury, during exercise. The protrusions 114 are generally rectangular in shape, although many other shapes are contemplated herein. The protrusions 114 are generally found in the neck 110, where the external handle is inserted, but could be located in the body 102 closer to the grip 108 if so desired. The number and position of the one or more protrusions 114 can dictate the placement of the handle relative to the clamp 100. For example, four protrusions 114 spaced regularly can allow the external handle to be rotated 90 degrees, 180 degrees, and 270 degrees relative to the clamp 100. This can allow different configurations, as described below.

Figure 2:
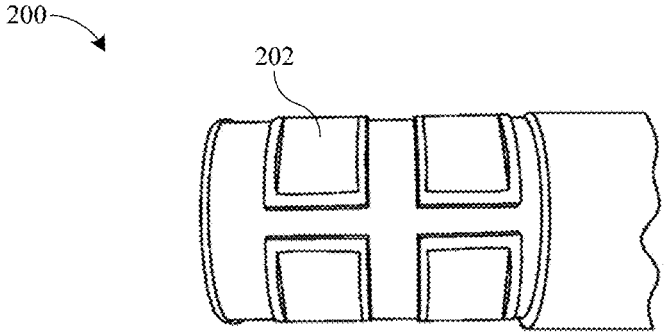
FIG. 2 is a side view illustration of an example of an external handle to be inserted into a clamp, such as the clamp of FIG. 1A.

FIG. 2 illustrates an example of an external handle 200 to be inserted into a clamp, such as the clamp 100 of FIG. 1. The external handle can be any desired handle, such as a barbell, curl bar, kettle bell handle, macebell handle, trap bar, etc. I.e., the handle can be vary greatly, allowing the user to select from a wide range of equipment, all using a single set of weights, such as dumbbells.

FIG. 2 shows that the external handle 200 can include one or more indentations 202. The one or more indentations 202 are configured to mate with the protrusions in a clamp (such as the protrusions 110 shown in FIG. 1). The one or more indentations 202 serve at least two functions. They stop the clamp from being removed from the external handle 200 until desired. In addition, they stop the clamp from rotating relative to the external handle 200. Either one (separation of the external handle 200 or rotation of the external handle 200) could lead to problems, including injury, during exercise. The one or more indentations 202 are generally rectangular in shape, although many other shapes are contemplated herein. As long as the indentation match the protrusions in the clamp and serve the above functions, then they are an acceptable size and shape. The one or more indentations 202 are generally found near the end of the external handle 200, where the external handle 200 is inserted into the clamp but could be located farther from the edge of the external handle 200 if more of the handle is to be inserted into the clamp. The number and position of the one or more indentations 202 can dictate the placement of the handle relative to the clamp 100. For example, four indentation 202 spaced regularly can allow the external handle 200 to be rotated 90 degrees, 180 degrees, and 270 degrees relative to the clamp. This can allow different configurations, as described below.

Figure 3A:
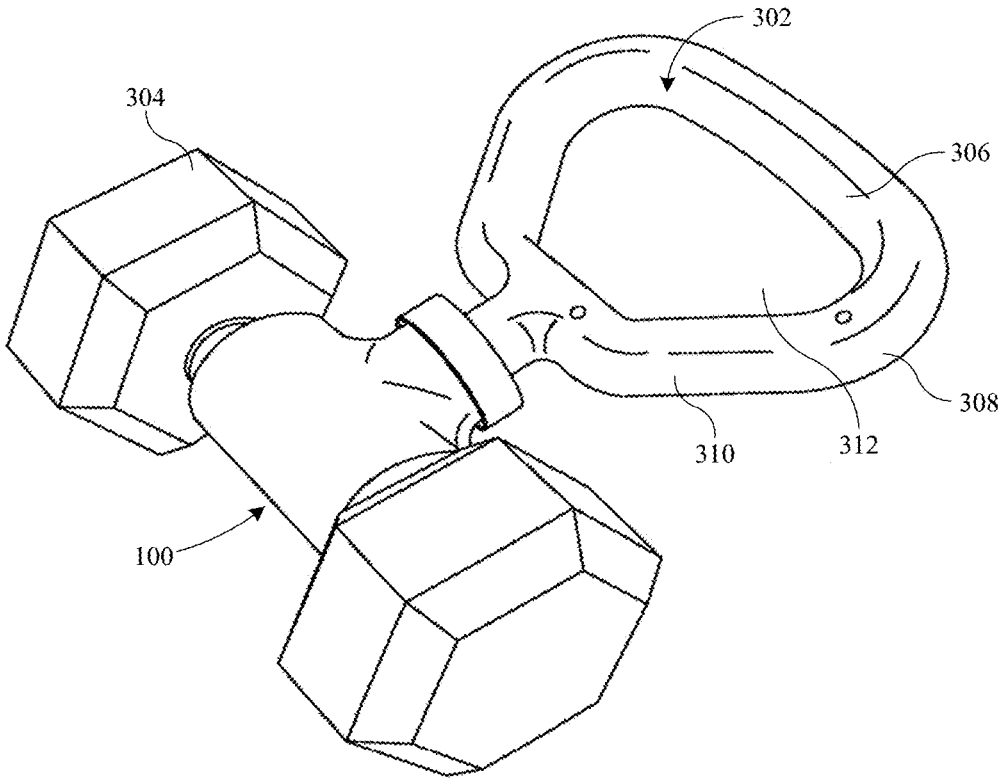
FIG. 3A is a perspective view illustration of an example of an external handle in combination with a clamp and a dumbbell in a locked configuration.
Figure 3B:
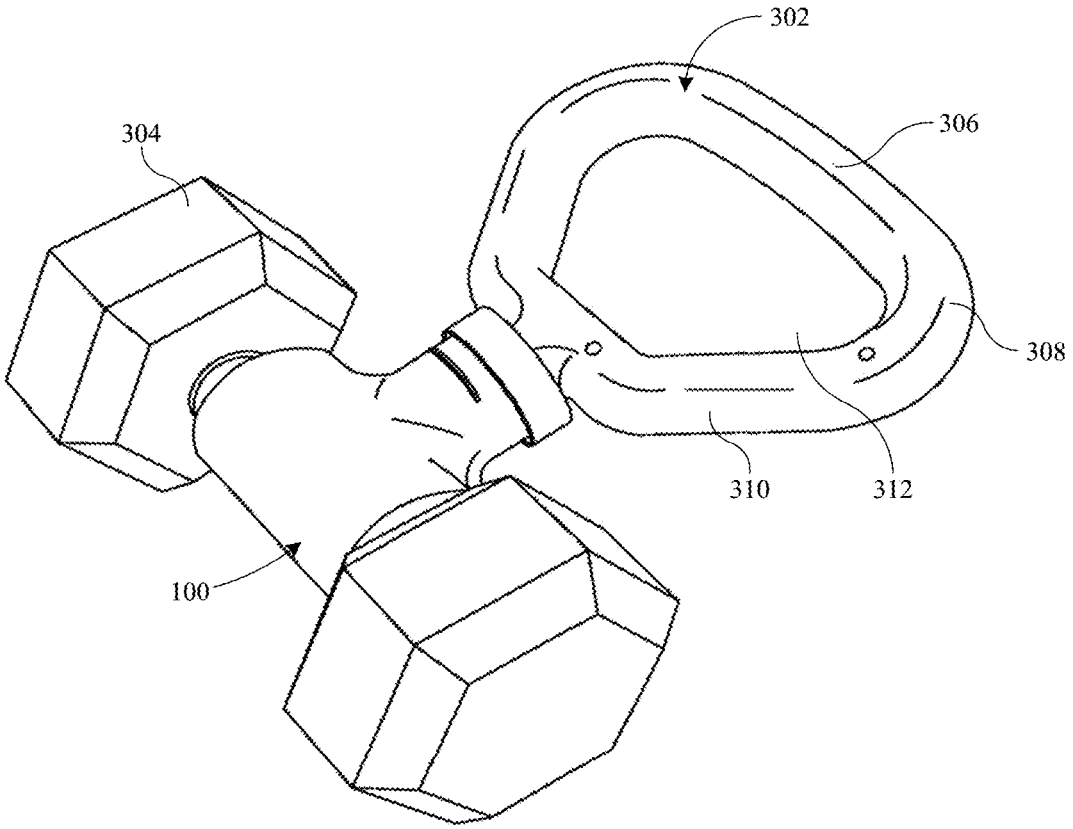
FIG. 3B is a perspective view illustration of the external handle of FIG. 3A in combination with a clamp and a dumbbell in an unlocked configuration.
Figure 3C:
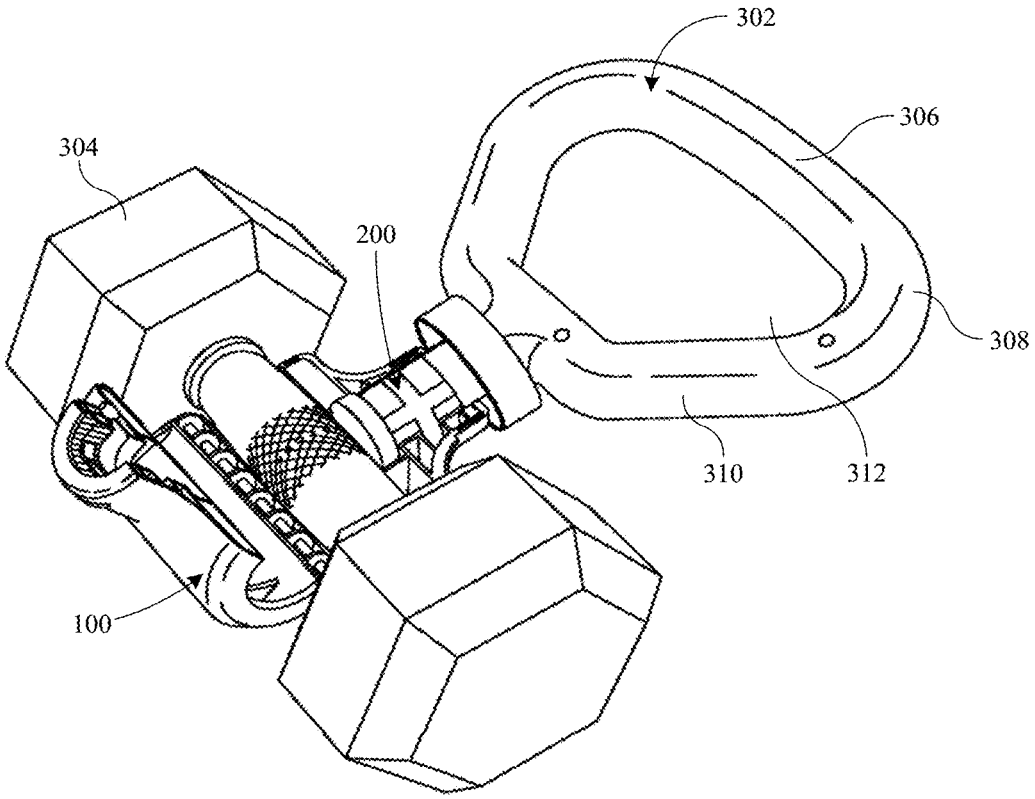
FIG. 3C is a perspective view illustration of the external handle of FIG. 3A in combination with a clamp in the open configuration and a dumbbell.

FIGS. 3A-3C (collectively "FIG. 3") illustrate an example of a kettlebell handle 302 in combination with a clamp 100. FIG. 3A shows the example of kettlebell handle 302 in combination with a closed instance of the clamp 100 and in combination with a dumbbell 304; FIG. 3B shows the example of kettlebell handle 302 in combination with a clamp 100 with the collar 112 unlocked and in combination with a dumbbell 304; and FIG. 3C shows the example of kettlebell handle 302 in combination with a clamp 100 in an open position and in combination with a dumbbell 304. The kettlebell handle 302 and clamp 100 together are configured to allow a user to transform a dumbbell 304 into a kettlebell. That is, a user can attach the kettlebell handle 302 and clamp 100 to a dumbbell 304 and then use the resulting combination as if it were a kettlebell.

Unlike traditional dumbbells, a kettlebell's center of mass is extended beyond the hand. This facilitates ballistic and swinging movements. The kettlebell allows for swing movements and release moves with added safety and added grip, wrist, arm and core strengthening. The weight of a kettlebell is not distributed evenly. Thus, the unique shape of a kettlebell provides the "unstable force" for handling—key for the effectiveness of the kettlebell exercises. By their nature, typical kettlebell exercises build strength and endurance, particularly in the lower back, legs, and shoulders, and increase grip strength. Unlike the exercises with dumbbells or barbells, kettlebell exercises involve large numbers of repetitions in the sport and can also involve large reps in normal training. Kettlebell exercises are in their nature holistic; therefore, they work several muscles simultaneously and may be repeated continuously for several minutes or with short breaks. This combination makes the exercise partially aerobic and more similar to high-intensity interval training rather than to traditional weight lifting.

Some exercises are uniquely suited to the kettlebell for one reason or another (although other exercises can be performed with kettlebells). For example, exercises which can be done with a single kettlebell include (but are not limited to): American swing, Turkish get-up, halo, arm bar, slingshot, slingshot lunge, circular swing, figure-8 swing, circular clean, deck squat, helping hand press, isometric holds, bent press, arm bar floor press, and Russian twist. Exercises which can be done with two kettlebells include (but are not limited to): renegade row, alternating clean, pushup, and carry. Exercises which can be done with a single kettlebell or with two or more kettlebells include (but are not limited to): conventional swing, high pull, hang clean, swing clean, dead clean, snatch, strict press, floor press, push press, jerk, thruster, squat, overhead squat, sots press, lunge press, pistol squat, deadlift, carry, row, lunge, lateral lunge, lateral lunge clean, squat get-up, windmill, and farmer's walk.

FIG. 3 shows that the kettlebell handle 302 is a "loop" of material. The size and shape of the loop can vary based on a number of factors, such as user hand size, exercises desired to be performed, material used, etc. The kettlebell handle 302 is cylindrical with a diameter of approximately 1.25 inches. The kettlebell handle 302 is comprised of any desired material, such as polycarbonate. The surface of the kettlebell handle 302 can be textured to prevent slipping when being held by a user. As used in the specification and the claims, the term approximately shall mean that the value is within 10% of the stated value, unless otherwise specified.

FIG. 3 shows that the kettlebell handle 302 can include a handgrip 306. The handgrip 306 includes a portion of the kettlebell handle 302 where the user can wrap his/her hands around the kettlebell handle 302. Exemplarily, the handgrip 306 is approximately 6 inches in length, allowing the user to place one or both hands on the handgrip 306.

FIG. 3 shows that the kettlebell handle 302 includes an external handle 200 which can mate with the clamp 100. If the external handle 200 includes rotational symmetry, then the kettlebell handle can be rotated relative to the clamp 100 (and therefore the dumbbell 304), which allows for variation of exercises. For example, because the kettlebell handle 302 as shown has two-fold symmetry but the external handle 200 as shown has four-fold symmetry, then the handgrip 306 can be aligned in axis with the dumbbell 304 or perpendicular to the dumbbell 304.

FIG. 3 also shows that the kettlebell handle 302 can include corners 308. The corners 308 are at each end of the handgrip 306. The corners 308 are where the kettlebell handle 302 turns from the handgrip toward the center of gravity (which in this configuration would be somewhere near the middle of the dumbbell handle—the exact location would depend on the weight of the dumbbell used). The corners 308 form an area where the user can use an alternative grip to the handgrip 306. I.e., if the user holds the kettlebell handle 302 at the corners 308 in an overhand grip (palm on the outside of the corners 308 and fingers wrapped around into the interior of the corners 308) or an underhand grip (palm on the inside of the corners 308 and fingers wrapped around to the exteriors of the corners 308) to change the dynamics of an exercise. For example, if the user is holding the kettlebell handle 302 straight out, then the exercise is different if the user is holding the handgrip 306 versus the corners 308.

FIG. 3 further shows that the kettlebell handle 302 can include horns 310. The horns 310 connect the corners 308 to the external handle 200 of the kettlebell handle 302. This completes the loop of the kettlebell handle 302. Just as with the corners 308, the horns 310 allow the user to utilize different grips in order to vary exercises.

FIG. 3 shows that the kettlebell handle 302 can include a window 312. The window 312 is an opening through which the user's hands, arms, feet, or other objects can be inserted. I.e., the kettlebell handle 302 is a loop, and the window 312 is the interior portion of the loop.

In addition, kettlebells have portions usually referred to as the "bell" and the "base". These are both formed by the dumbbell 304 when the clamp 100 is closed around the dumbbell handle 314. Likewise, the offset weight of the kettlebell is created by the attached dumbbell 304. Thus, with a single instance of the kettlebell handle 302 or pair of kettlebell handles 302, the user can covert a dumbbell set into a matching kettlebell set. This greatly reduces the cost and storage space needed to create a home gym.

Figure 4A:
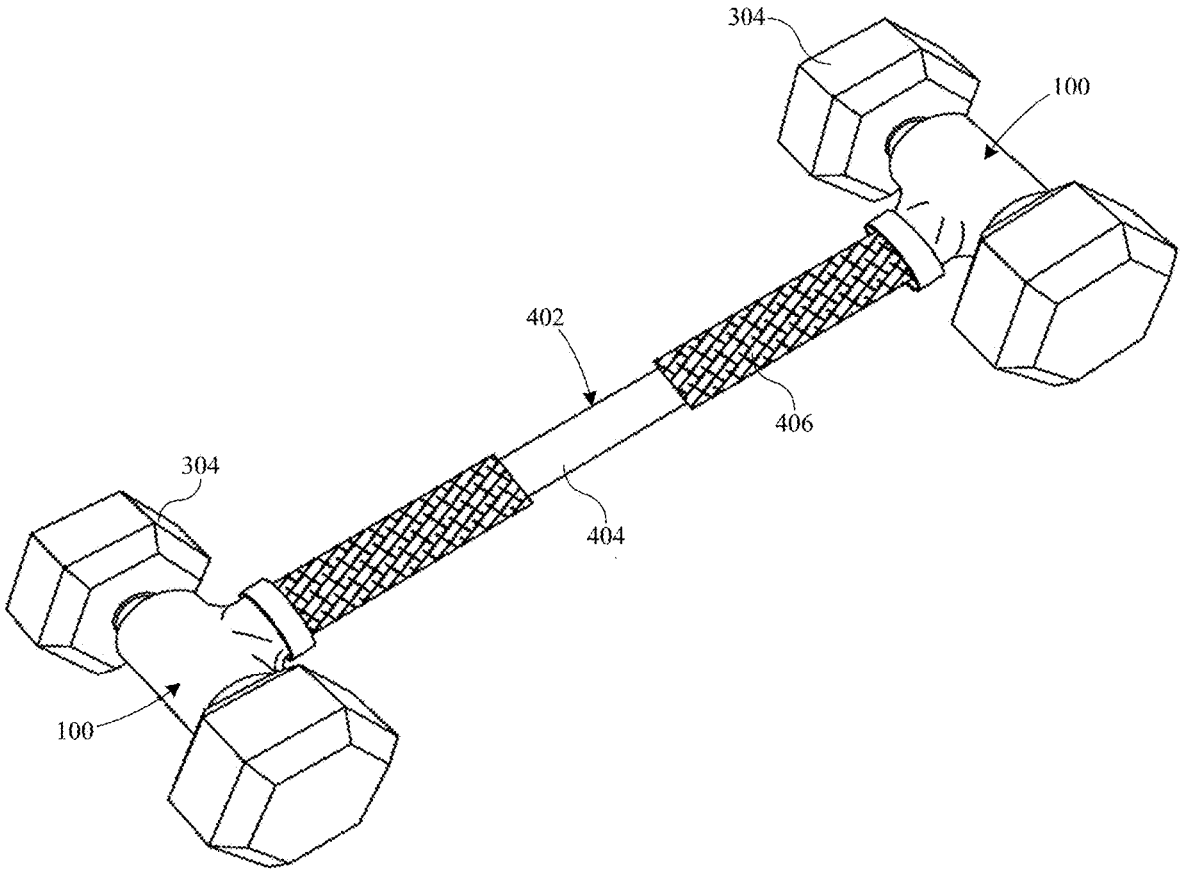
FIG. 4A is a perspective view illustration of another example of an external handle in combination with a pair of clamps and dumbbells.
Figure 4B:
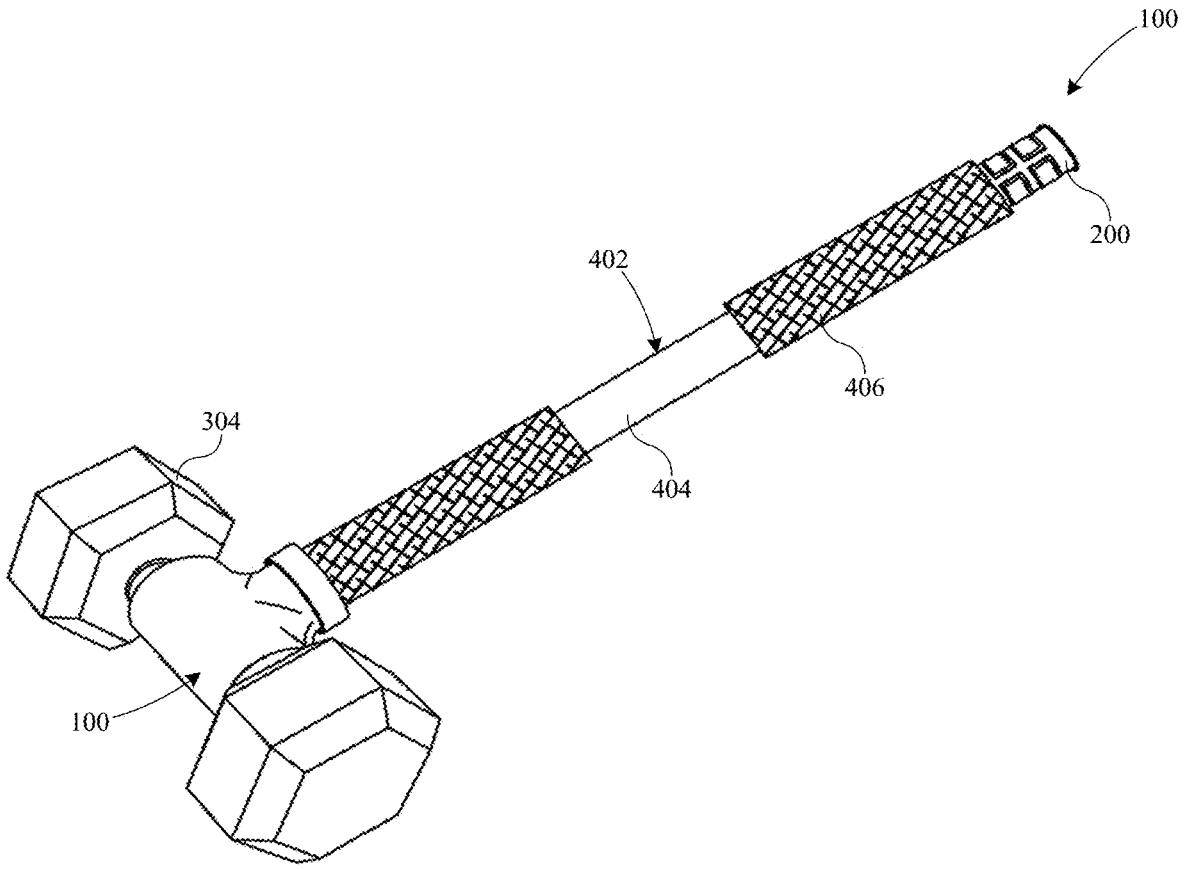
FIG. 4B is a perspective view illustration of the external handle of FIG. 4A in combination with one of the clamps and one of the dumbbells of FIG. 4A.
Figure 4C:
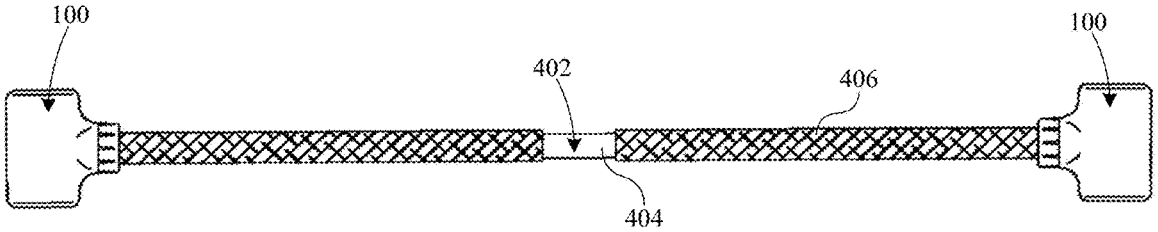
FIG. 4C is a top view illustration of the external handle with the pair of clamps of FIG. 4A.
Figure 4D:
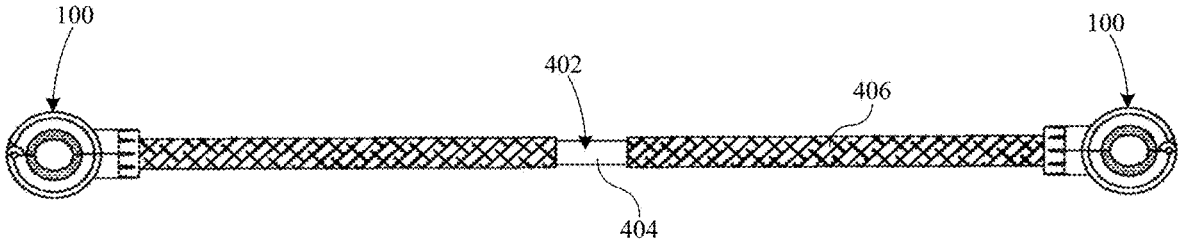
FIG. 4D is a front view illustration of the external handle with the pair of clamps of FIG. 4A.
Figure 4E:
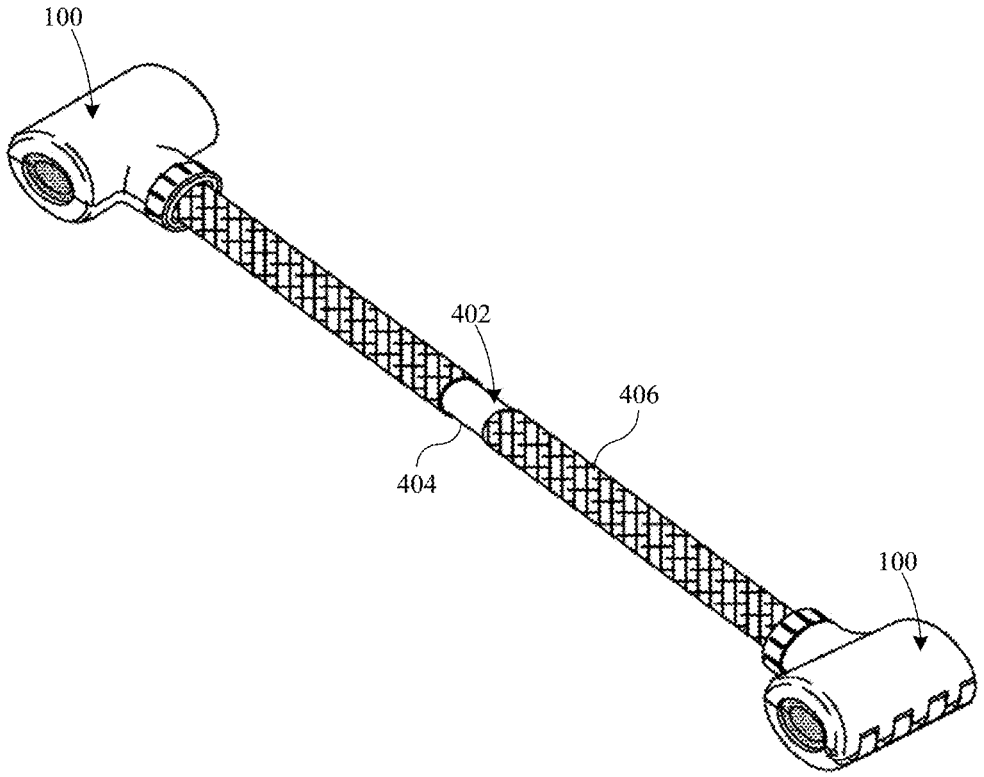
FIG. 4E is a perspective view illustration of the external handle with the pair of clamps of FIG. 4A.

FIGS. 4A-4B (collectively "FIG. 4") illustrate an example of a barbell handle 402. FIG. 4A shows the example of the barbell handle 402 including a pair of closed instances of clamps 100 in combination with a pair of dumbbells 304; FIG. 4B shows the example of the barbell handle 402 including a single closed instance of the clamp 100 in combination with a single instance of the dumbbell 304; FIG. 4C shows a top view of the example of the barbell handle 402 including a pair of closed instances of clamps 100, with the bottom view being a mirror image thereof; FIG. 4D shows a front view of the example of the barbell handle 402 including a pair of closed instances of clamps 100, with the rear view being a mirror image thereof; and FIG. 4E shows a perspective view of the example of the barbell handle 402 including a pair of closed instances of clamps 100. The barbell handle 402 and clamp 100 together are configured to allow a user to transform a dumbbell 304 into a barbell. That is, a user can attach the barbell handle 402 and clamp 100 to a dumbbell 304 and then use the resulting combination as if it were a barbell.

A barbell is a piece of exercise equipment used in weight training, bodybuilding, weightlifting and powerlifting, consisting of a long bar, usually with weights attached at each end. Barbells range in length from 1.2 meters (4 ft) to above 2.4 meters (8 ft), although bars longer than 2.2 meters (7.2 ft) are used primarily by powerlifters and are not commonplace. The central portion of the bar varies in diameter from 25 millimeters (0.98 in) to 50 millimeters (1.96 in) and is often engraved with a knurled crosshatch pattern to help lifters maintain a solid grip. Weight plates slide onto the outer portions of the bar to increase or decrease the desired total weight.

One can view a barbell as a longer version of the dumbbell that is used for free weight training and competitive sports, such as powerlifting, Olympic weightlifting, and CrossFit. Many exercises can be done using the barbell, such as bicep curl, bench press, Olympic weightlifting, overhead press, deadlift, and squat. Olympic barbells are usually an estimated weight of 20 kilograms (44 lb.), but the weight of a barbell can vary depending on the desired use. Many fitness categories use the barbell for different reasons, for example, powerlifters use the barbell to perform compound exercise movements.

FIG. 4 shows that the barbell handle 402 includes a bar 404. The size and shape of the bar 404 can vary based on a number of factors, such as exercises desired to be performed, material used, etc. Exemplary, the size of the bar 404 can be is cylindrical with a diameter of approximately 1 inch and have a length of approximately 36 inches. The bar 404 is comprised of any desired material, such as steel. The surface of the bar 404 can be textured to prevent slipping when being held by a user. A powder coating, knurling, grip, or tape can be used to prevent slipping.

FIG. 4 shows that the barbell handle 402 can include a handgrip 406. The handgrip 406 is the portion of the bar 404 where the user wraps his/her hands around the barbell handle 402. Then handgrip 406 includes vinyl, rubber or a similar material such as PVC, TPE, silicone, or other common polymers used for grips. The handgrip 406 prevents the user's hands from slipping.

FIG. 4 shows that the barbell handle 402 includes an external handle 200 which can mate with the clamp 100. Rotational symmetry is not as important to the barbell handle 402 as the kettlebell handle 302, discussed above.

Removing a clamp 100 from a single instance of the external handle 200 allows the user to use the barbell handle 402 as a macebell. This allows the user to do sledgehammer type exercises. I.e., only a single dumbbell will be attached to the bar clamp. This allows the user to perform exercises such as hammering tires or other hammer workouts.

Figure 5:
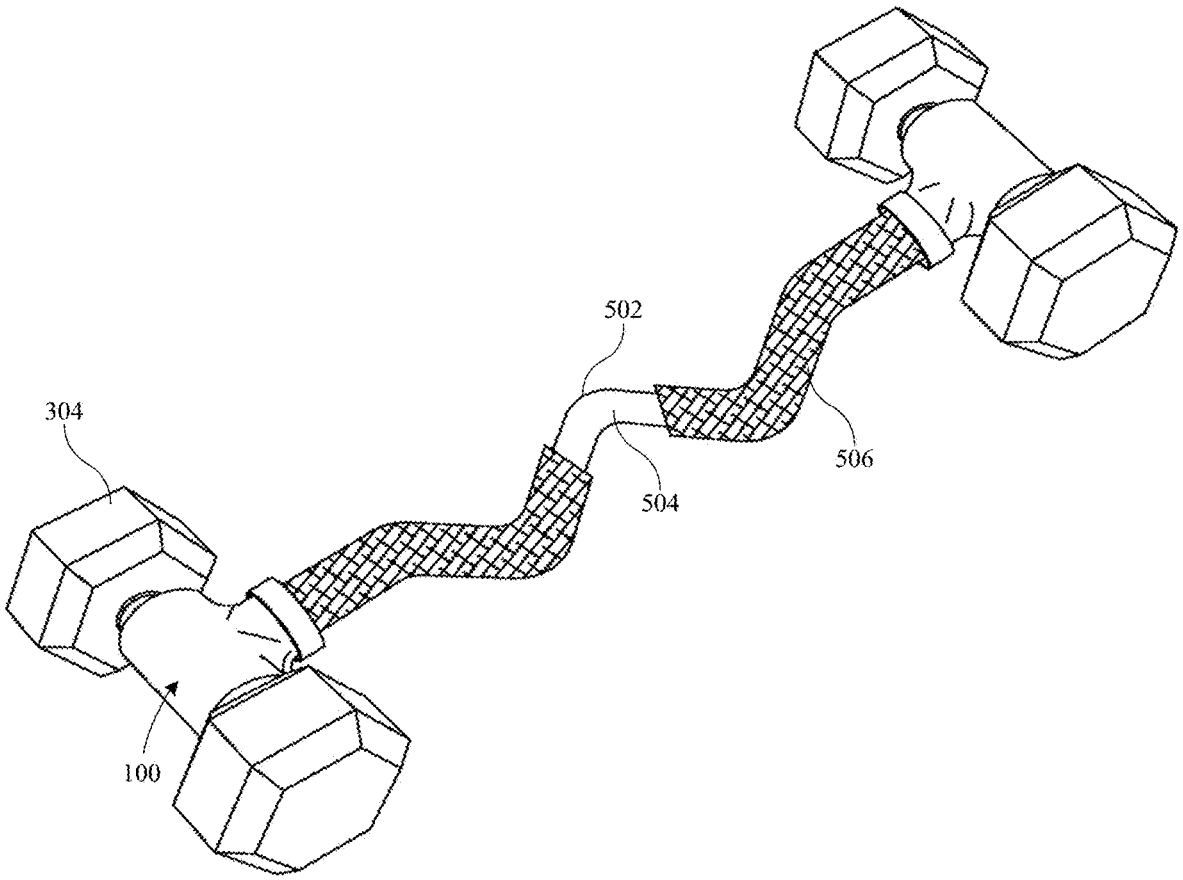
FIG. 5 is a perspective view illustration of another example of an external handle in combination with a pair of clamps and dumbbells.

FIG. 5 illustrates an example of an EZ curl bar handle 502 including a pair of closed instances of clamps 100 in combination with a pair of dumbbells 304. The EZ curl bar handle 502 and clamp 100 together are configured to allow a user to transform a dumbbell 304 into a EZ curl bar. That is, a user can attach the EZ curl bar handle 502 and clamp 100 to a dumbbell 304 and then use the resulting combination as if it were a EZ curl bar.

A EZ curl bar is a piece of exercise equipment used in weight training, bodybuilding, weightlifting and powerlifting, consisting of a non-straight bar, usually with weights attached at each end. The central portion of the bar varies in diameter from 25 millimeters (0.98 in) to 50 millimeters (1.96 in) and is often engraved with a knurled crosshatch pattern to help lifters maintain a solid grip. Weight plates slide onto the outer portions of the bar to increase or decrease the desired total weight. EZ curl bars are configured to turn the user's hands slightly for use during bicep curls. The angles of the bar allow for increased comfort of the wrists when doing certain exercises and to better isolate certain muscles, such as the biceps.

FIG. 5 shows that the EZ curl bar handle 502 includes a bar 504. The size and shape of the bar 504 can vary based on a number of factors, such as exercises desired to be performed, material used, etc. Exemplary, the size of the bar 504 can be is cylindrical with a diameter of approximately 1 inch and have a length of approximately 36 inches. The bar is comprised of any desired material, such as steel. The surface of the bar 504 can be textured to prevent slipping when being held by a user.

FIG. 5 also shows that the bar 504 is not straight as in a barbell. This allows a user to turn his/her hands slightly while performing a barbell curl. This makes the exercise more comfortable for the user.

FIG. 5 shows that the EZ curl bar handle 502 can include a handgrip 506. The handgrip 506 is the portion of the bar 504 where the user wraps his/her hands around the EZ curl bar handle 502. Then handgrip 506 includes vinyl, but other materials can be used such as rubber, TPE, PVC, silicone, or other polymers and prevents the user's hands from slipping. A texture such as a knurling can also be applied directly to the steel bar to prevent hands from slipping.

FIG. 5 shows that the EZ curl bar handle 502 includes an external handle (not shown) which can mate with the clamp 100. Rotational symmetry is not as important to the EZ curl bar handle 502 as the kettlebell handle 302, discussed above.

Figure 6:
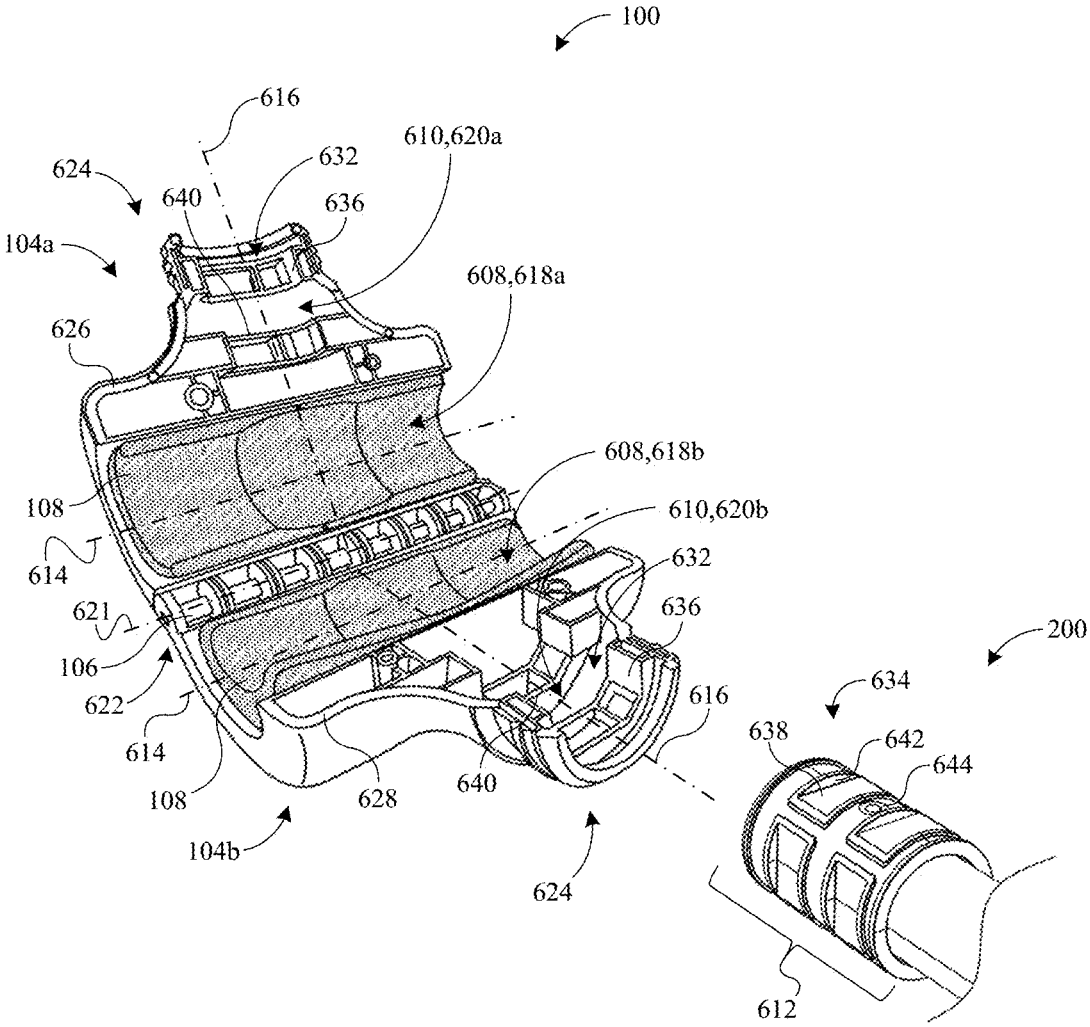
FIG. 6 is a partial exploded view illustration of the clamp of FIG. 1A in an open configuration in connection with an example of an external handle.

FIG. 6 shows an example of a clamp 100 in an open configuration and an example of a portion of an external handle 200, such as the kettlebell handle 302, the barbell handle 402, or the EZ curl bar handle 502, removed from the clamp 100. The clamp 100 may include the first portion 104*a*, the second portion 104*b*, and the hinge 106. As described previously, the clamp 100 may be configured to connect exercise equipment to the external handle 200 to enable the exercise equipment to be used (e.g., lifted) with the external handle 200. Accordingly, the clamp 100 may be connected to the exercise equipment and the external handle 200 such that the exercise equipment is positionally secured (e.g., positionally fixed) relative to the external handle 200.

The clamp 100 may define a first cavity 608 and/or a second cavity 610. The first cavity 608 may be configured to extend around (e.g., receive, secure, support) a portion of exercise equipment, and the second cavity 610 may be configured to extend around (e.g., receive, secure, support) a portion of the external handle 200. The first cavity 608 may be referred to herein as a "body cavity" and the second cavity 610 may be referred to herein as a "neck cavity." As previously indicated, the exercise equipment may be or include a dumbbell, such as the dumbbell 304, and the portion of the exercise equipment may be or include a handle of the dumbbell. In some implementations, however, the exercise equipment may be some other portion of a dumbbell or may be some other free weight or portion thereof. Furthermore, the portion of the external handle 200 may include an end 612 of the external handle 200 that is configured to interface with the clamp 100, as explained in further detail below. The end 612 of the external handle 200 may be larger than a remainder of the external handle 200. For example, an outer diameter of the end 612 may be larger than an outer diameter of the remainder of the external handle.

The first cavity 608 may be elongated such as to extend along a first axis 614. In some implementations, the second cavity 610 may also be elongated such as to extend along a second axis 616. The first axis 614 may be referred to herein as a "body axis" and the second axis 616 may be referred to herein as a "neck axis." In the illustrated implementation, the first cavity 608 extends through the clamp 100 along the first axis 614 and the second cavity 610 extends out of the clamp 100 from a location proximate (e.g., adjacent) to the first cavity 608 along the second axis 616. Furthermore, in the illustrated implementation, the first axis 614 is perpendicular to the second axis 616. In some implementations, the first axis 614 and the second axis 616 may not be perpendicular to each other and may instead be at some other angle relative to each other. Furthermore, in some implementations, the first axis 614 may intersect the second axis 616. In some implementations, the first cavity 608 may be substantially cylindrical, such as to extend around a substantially cylindrical handle of the exercise equipment. The second cavity 610 may also be substantially cylindrical, such as to extend around an implementation of the external handle 200 in which the end 612 thereof is substantially cylindrical. Where the first axis 614 is perpendicular to the second axis 616, the clamp 100 may resemble a T-shape, in which the first cavity 608 is defined within the upper portion of the T-shape, and the second cavity 610 is defined within the stem of the T-shape.

The first portion 104*a* and the second portion 104*b* of the clamp 100 may cooperatively define the first cavity 608 and/or the second cavity 610. For example, in some implementations, the first portion 104*a* of the clamp 100 may define a first portion 618*a* of the first cavity 608 and a first portion 620*a* of the second cavity 610, and the second portion 104*b* of the clamp 100 may define a second portion 618*b* of the first cavity 608 and a second portion 620*b* of the second cavity 610. In the illustrated implementation, the first portion 104*a* and the second portion 104*b* of the clamp 100 each define approximately half of each of the first cavity 608 and the second cavity 610. In some implementations, the first portion 618*a* of the first cavity 608 may be a majority of the first cavity 608 and the second portion 618*b* of the first cavity 618 may be a remaining minority of the first cavity 608. Similarly, the first portion 620*a* of the second cavity 610 may be a majority of the second cavity 610 and the second portion 620*b* of the second cavity 610 may be a minority of the second cavity 610. In some implementations, the first portion 104*a* of the clamp 100 may define an entirety of the first cavity 608 and the second portion 104*b* of the clamp 100 may define an entirety of the second cavity 610. In other implementations, the first portion 104*a* of the clamp 100 may define an entirety of the first cavity 608 and an entirety of the second cavity 610.

The first portion 104*a* of the clamp 100 may be connected to the second portion 104*b* of the clamp 100 by the hinge 106. For example, in the illustrated implementation, the hinge 106 rotatably connects (e.g., pivotally connects) a first end 622 of each of the first portion 104*a* and the second portion 104*b* such as to form a clamshell configuration of the first portion 104*a* and the second portion 104*b*. Accordingly, in such an implementation, the first portion 104*a* of the clamp 100 may be referred to as a first clamshell portion and the second portion 104*b* of the clamp 100 may be referred to as a second clamshell portion. The hinge 106 may define a hinge axis 621 about which the first portion 104*a* and the second portion 104*b* may rotate relative to each other. In some implementations, the hinge axis 621 may be parallel with the first axis 614 of the first cavity 608. The hinge 106 may be any type of hinge that provides a rotatable (e.g., pivotable) connection between the first portion 104*a* and the second portion 104*b* of the clamp 100. For example, the hinge 106 may be a barrel hinge, a living hinge, a butt hinge, a piano hinge, or some other type of hinge. By rotatably (e.g., pivotably) connecting the first portion 104*a* and the second portion 104*b*, the hinge 106 may enable the clamp 100 to selectively transition between an open configuration of the clamp 100 and a closed configuration of the clamp 100.

When the clamp 100 is in the open configuration, a second end 624 of each of the first portion 104*a* and the second portion 104*b* that is opposite the first end 622 may be positioned distal (e.g., separate) from one-another such as to present the first cavity 608 and the second cavity 610 for receipt of respective portions of the exercise equipment (e.g., a handle of a dumbbell) and the external handle 200 (e.g., the end 612 of the external handle 200).

For example, where the first portion 104*a* of the clamp 100 includes the first portion 618*a* of the first cavity 608, the first portion 104*a* of the clamp 100 may be configured to receive the portion of the exercise equipment within the first portion 618*a* of the first cavity 608 when the clamp 100 is in the open configuration. Additionally or alternatively, where the second portion 104*b* of the clamp 100 includes the second portion 618*b* of the first cavity 608, the second portion 104*b* of the clamp 100 may be configured to receive the portion of the exercise equipment within the second portion 618*b* of the first cavity 608 when the clamp 100 is in the open configuration. Furthermore, for example, where the first portion 104*a* of the clamp 100 includes the first portion 620*a* of the second cavity 610, the first portion 104*a* of the clamp 100 may be configured to receive the portion of the external handle 200 within the first portion 620*a* of the second cavity 610 when the clamp 100 is in the open configuration. Additionally or alternatively, where the second portion 104*b* of the clamp 100 includes the second portion 620*b* of the second cavity 610, the second portion 104*b* of the clamp 100 may be configured to receive the portion of the external handle 200 within the second portion 620*b* of the second cavity 610 when the clamp 100 is in the open configuration.

When the clamp 100 is in the closed configuration, the first portion 104*a* and/or the second portion 104*b* may clamp down over the portion of the exercise equipment and over the portion of the external handle 200 to secure the exercise equipment relative to the external handle 200. Stated differently, when the clamp 100 is in the closed configuration, the second end 624 of each of the first portion 104*a* and the second portion 104*b* may be positioned proximate (e.g., adjacent) to one-another such that the first portion 104*a* and the second portion 104*b* of the clamp 100 cooperatively form the first cavity 608 and/or the second cavity 610. In some implementations, the first portion 104*a* of the clamp 100 may include a first face 626 and the second portion 104*b* of the clamp 100 may include a second face 628 that is configured to contact the first face 626 of the first portion 104*a* when the clamp 100 is in the closed configuration. In other implementations, the first cavity 608 and/or the second cavity 610 may be sized such that the first face 626 and the second face 628 do not contact each other when the clamp 100 is in the closed configuration. Stated differently, the first cavity 608 and/or the second cavity 610 may be sized to extend only partially around the portion of the exercise equipment and the portion of the external handle 200 when the clamp 100 is in the closed configuration.

When the clamp 100 is in the closed configuration, the portion of the exercise equipment may be secured (e.g., fixed) within the first cavity 608 and the portion of the external handle 200 may be secured (e.g., fixed) within the second cavity 610 such that the external handle 200 is inhibited from moving relative to the portion of the exercise equipment. For example, when the clamp 100 is in the closed configuration, the exercise equipment may be secured (e.g., positionally secured) relative to the external handle 200. As another example, when the clamp 100 is in the closed configuration, the exercise equipment may be fixed (e.g., positionally fixed) relative to the external handle 200.

To secure the portion of the exercise equipment within the first cavity 608, the first cavity 608 may include the grip 108. The grip 108 may be comprised of a compliant material that lines an inner surface of the first cavity 608. When the first cavity 608 receives the portion of the exercise equipment, the grip 108 may deform to match a shape of the portion of the exercise equipment and secure (e.g., fix, support) the portion of the exercise equipment within the first cavity 608. In some implementations, by deforming around the portion of the exercise equipment, the grip 108 may inhibit (e.g., prevent) the portion of the exercise equipment from rotating about and/or translating along the first axis 614. Furthermore, in some implementations, the grip 108 may comprise a material that has a relatively high coefficient of friction to inhibit (e.g., prevent) the portion of the exercise equipment from rotating about and/or translating along the first axis 614. The grip 108 may be or comprise an elastomeric material such as rubber, foam, or the like.

To secure the portion of the external handle 200 within the second cavity 610, the second cavity 610 may include geometric features 632 (e.g., the protrusions 114) that are configured to engage with corresponding geometric features 634 (e.g., the indentations 202) of the external handle 200. For example, as shown in the illustrated implementation, the geometric features 632 of the second cavity 610 may include one or more flat surfaces 636 that are spaced around (e.g., spaced equidistantly around) the second cavity 610, and the corresponding geometric features 634 of the external handle 200 may include corresponding flat surfaces 638 that are spaced around (e.g., spaced equidistantly around) the end 612 of the external handle 200 and that are configured to interface with the flat surfaces 636 of the second cavity 610.

In the illustrated implementation, for example, the second cavity 610 includes four of the flat surfaces 636 that are spaced around the second cavity 610 ninety-degrees relative to each other. Accordingly, the end 612 of the external handle 200 may include four of the corresponding flat surfaces 638 that are spaced around the end 612 of the external handle 200 ninety-degrees relative to each other. In other implementations, however, the second cavity 610 may include any number of the geometric features 632 (e.g., one, two, three, five, six, seven) of the geometric features 632, and the end 612 of the external handle 200 may include the same number of the corresponding geometric features 634. Through interface of the geometric features 632 (the flat surfaces 636) of the second cavity 610 with the corresponding geometric features 634 (the corresponding flat surfaces 638) of the external handle 200, the clamp 100 may be inhibited from rotating (e.g., rotating about the second axis 616) relative to the external handle 200 when the clamp 100 is in the closed configuration.

Furthermore, by spacing the geometric features 632 about the second cavity 610 and by spacing the corresponding geometric features 634 about the end 612 of the external handle 200, the rotational position of the clamp 100 may be adjusted relative to the external handle 200. For example, the external handle 200 may be in a first rotational position relative to the clamp 100. The clamp 100 may be opened (e.g., moved to the open configuration) and the external handle 200 may be rotated relative to the clamp 100 to a second rotational position relative to the clamp 100. Thereafter, the clamp 100 may be closed (e.g., moved to the closed configuration) to secure the clamp 100 in the second rotational position. Where the second cavity 610 includes four of the flat surfaces 636 spaced around the second cavity 610 ninety degrees relative to each other, and the end 612 of the external handle 200 includes four of the corresponding flat surfaces 638 that correspond with the flat surfaces 636 of the second cavity 610, the external handle 200 may be rotatably adjustable relative to the clamp 100 in increments of ninety degrees.

As shown, the geometric features 632 (e.g., the flat surfaces 636) of the second cavity 610 may protrude inward relative to (e.g., toward) the second axis 616 of the second cavity 610. In such an implementation, the corresponding geometric features 634 (e.g., the corresponding flat surfaces 638) of the end 612 of the external handle 200 may be recessed in order to receive the geometric features 632 of the second cavity 610. In other implementations, the configuration of the geometric features 632 of the second cavity 610 and the corresponding geometric features 634 of the end 612 of the external handle 200 may be reversed, such that the geometric features 632 of the second cavity 610 are recessed and the corresponding geometric features 634 of the end 612 of the external handle 200 protrude outward (e.g., protrude away from the second axis 616 of the second cavity 610) to be received by the geometric features 632 of the second cavity 610.

The geometric features 632 of the second cavity 610 may also include one or more ridges 640 that are configured to engage with one or more corresponding ridges 642 of the end 612 of the external handle 200 to inhibit (e.g., prevent) relative movement between the external handle 200 and the clamp 100 along the second axis 616. In other words, the ridges 640 of the second cavity 610 may be configured to interface with the corresponding ridges 642 of the external handle 200 to inhibit (e.g., prevent) axial movement (e.g., movement along the second axis 616) of the external handle 200 in and out of the second cavity 610. In the illustrated implementation, the ridges 640 of the second cavity 610 are formed from peripheral edges of the flat surfaces 636 of the second cavity 610 that protrude inward relative to (e.g., toward) the second axis 616. Accordingly, at least one of the ridges 640 of the second cavity 610 may be located axially between the flat surfaces 636 that extend around the second cavity 610. Furthermore, in the illustrated implementation, the corresponding ridges 642 of the end 612 of the external handle 200 are formed from walls of the flat surfaces 636 that are recessed and extend proud of an outer surface of the end 612. Accordingly, at least one of the corresponding ridges 642 of the external handle 200 may be located axially between the corresponding flat surfaces 638 that extend around the end 612 thereof.

In some implementations, one or more fasteners (not shown) may secure the clamp 100 in the closed configuration. Accordingly, the clamp 100 and the external handle 200 may include one or more apertures through which the one or more fasteners may extend. In some implementations, an aperture of the clamp 100 (not shown) may extend through the second cavity 610 of the clamp 100 and an aperture 644 of the external handle 200 may extend through the end 612 of the external handle 200. In some implementations, the fasteners may be configured to apply a compressive force between the first portion 104*a* of the clamp 100, the end 612 of the external handle 200, and the second portion 104*b* of the clamp 100 to secure the clamp 100 relative to the external handle 200. Additionally or alternatively, the fasteners may be configured to apply a compressive force between the first portion 104*a* of the clamp 100, the portion of the exercise equipment, and the second portion 104*b* of the clamp 100 to secure the clamp 100 relative to the exercise equipment.

In some implementations, to secure the clamp 100 in the closed configuration, a single one of the fasteners may extend through the first portion 104*a* of the clamp 100, through the aperture 644 of the end 612 of the external handle 200, and through the second portion 104*b* of the clamp 100 to be received by a corresponding fastener (not shown). For example, where the fastener 646 is a threaded fastener having external threads (e.g., is a bolt), the corresponding fastener may be a threaded fastener having internal threads (e.g., may be a nut).

In some implementations, multiple of the fasteners may be used to secure the clamp 100 to the external handle 200 and to secure the clamp 100 in the closed configuration. For example, a first fastener (not shown) may be configured to connect the first portion 104*a* of the clamp 100 to the external handle 200 and a second fastener (not shown) may be configured to connect the second portion 104*b* of the clamp 100 to the external handle 200 and/or to the first portion 104*a* of the clamp 100 to secure the clamp 100 in the closed configuration. To connect the first portion 104*a* of the clamp 100 to the external handle 200, the first fastener may extend through the first portion 104*a* of the clamp 100 and only partially through the end 612 of the external handle 200 (e.g., the aperture 644 of the end 612 may extend only partially through the end 612). For example, where the first fastener is a threaded fastener with external threads (e.g., is a bolt), the end 612 (e.g., the aperture 644 of the end 612) may include corresponding internal threads that are configured to interface with the first fastener to connect the first portion 104*a* to the external handle 200.

To connect the second portion 104*b* of the clamp 100 to the external handle 200 and/or the first portion 104*a* of the clamp 100, the second fastener may extend through the second portion 104*b* of the clamp 100 and only partially through the end 612 of the external handle 200 or only partially through the first portion 104*a* of the clamp 100. For example, where the second fastener is a threaded fastener with external threads (e.g., is a bolt), the end 612 (e.g., another aperture of the end 612) may include corresponding internal threads that are configured to interface with the second fastener to connect the second portion 104*b* of the clamp 100 to the external handle 200 (e.g., to secure the clamp 100 in the closed configuration). As another example, where the second faster is a threaded fastener with external threads (e.g., is a bolt), the first portion 104*a* may include corresponding internal threads that are configured to interface with the second fastener to connect the second portion 104*b* of the clamp 100 to the first portion 104*a* (e.g., to secure the clamp 100 in the closed configuration).

In some implementations, the fastener 646 may be or include a collar 112 that is configured to extend around the external handle 200 and portions of the first portion 104*a* and the second portion 104*b* of the clamp 100 (e.g., the second end 624 of each of the first portion 104*a* and the second portion 104*b*) to connect the first portion 104*a* to the second portion 104*b*. The collar 112 may include internal threads that are configured to interface with corresponding external threads located on the first portion 104*a* of the clamp 100 and/or the second portion 104*b* of the clamp 100 to releasably connect the collar 112 to the clamp 100 and secure the clamp 100 in the closed configuration. For example, to connect the second portion 104*b* of the clamp 100 to the first portion of the clamp 100, the second end 624 of each of the first portion 104*a* and the second portion 104*b* may include external threads onto which the collar 112 may be screwed such that the collar 112 extends around the second end 624 of each of the first portion 104*a* and the second portion 104*b*. By extending around the second end 624 of each of the first portion 104*a* and the second portion 104*b*, the clamp 100 may be secured in the closed configuration via the tensile strength of the collar 112, which may be more robust that other means of securing the clamp 100 in the closed configuration (e.g., may be more robust that a bolt extending through the clamp 100 and the external handle 200 as explained above).

In some implementations, another fastener may be configured to connect the first portion 104*a* of the clamp 100 to the external handle 200 and the collar 112 may be configured to connect the first portion 104*a* of the clamp 100 to the second portion 104*b* to secure the clamp 100 in the closed configuration. In such an implementation, to connect the first portion 104*a* of the clamp 100 to the external handle 200, the other fastener may extend through the first portion 104*a* of the clamp 100 and only partially through the end 612 of the external handle 200. For example, where the other fastener is a threaded fastener with external threads (e.g., is a bolt), the end 612 (e.g., the aperture 644 of the end 612) may include corresponding internal threads that are configured to interface with the other fastener to connect the first portion 104*a* to the external handle 200.

In some implementations, the fastener may be or include one or more snaps (not shown) that are configured to releasably connect the first portion 104*a* of the clamp 100 to the second portion 104*b* of the clamp 100 in the closed configuration. For example, the first portion 104*a* may include a first portion of a snap and the second portion 104*b* may include a second portion of the snap that is configured to interface with the first portion of the snap to connect the second portion 104*b* to the first portion 104*a* in the closed configuration. In some implementations, the first portion of the snap may be positioned at the second end 624 of the first portion 104*a* of the clamp 100 and the second portion of the snap may be positioned at the second end 624 of the second portion 104*b* of the clamp 100.

Figure 7:
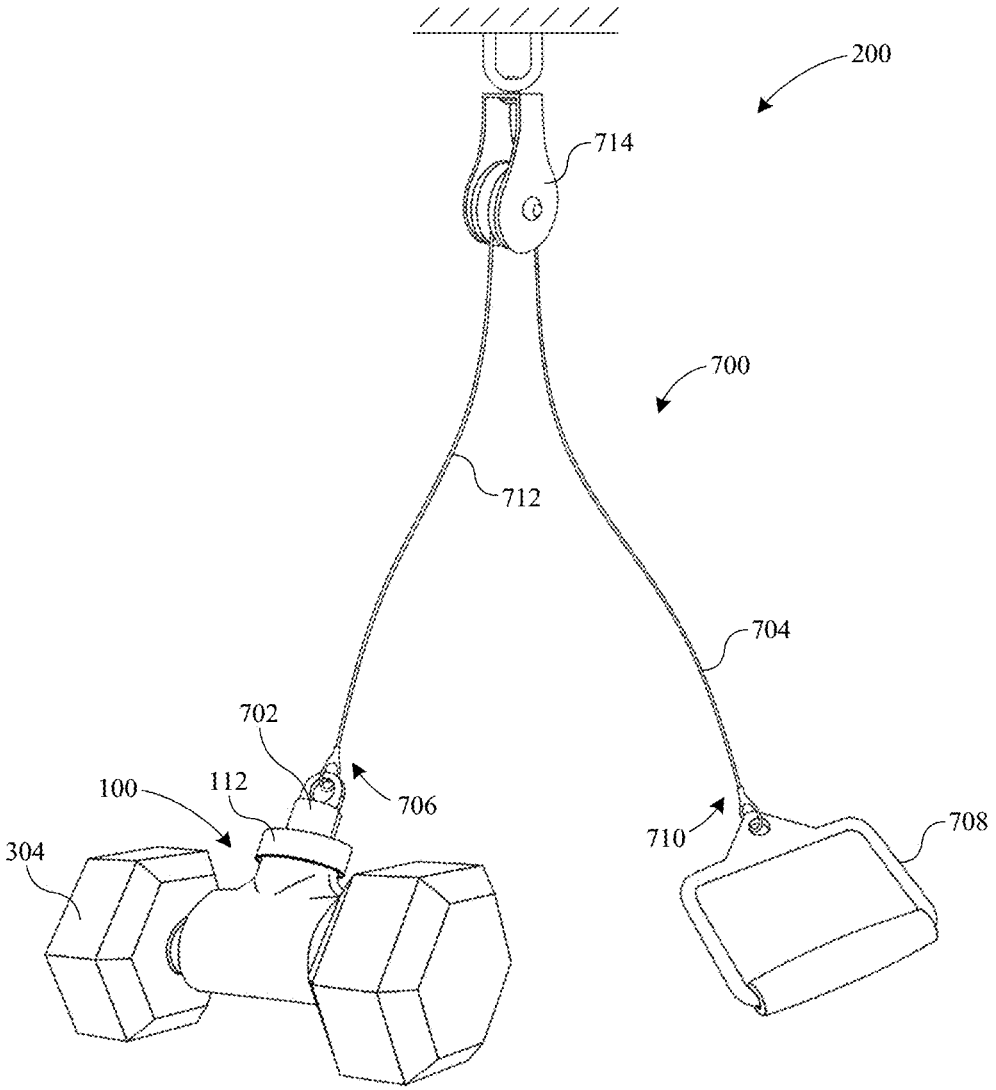
FIG. 7 is a perspective view illustration of another example of an external handle in combination with a clamp and a dumbbell.

FIG. 7 shows the clamp 100 connecting exercise equipment to an example of the external handle 200 that comprises a cable system 700 and a cable connector 702. In the illustrated implementation, the exercise equipment is a dumbbell. The cable connector 702 of the external handle 200 may include the end 612 of the external handle 200 and thus may be releasably connectable to the clamp 100 (e.g., may be releasably received by the second cavity 610 of the clamp 100) as previously described. The cable system 700 may include a cable 704 that is connected to the cable connector 702 at a first end 706, that is connected to a cable handle 708 at a second end 710 that is opposite the first end 706, and that has a length 712 that extends from the first end 706 to the second end 710. In some implementations, the length 712 of the cable 704 may extend through a pulley 714 (e.g., may interface with the pulley 714). The pulley 714 may be secured to a fixture (e.g., a wall, a ceiling, a mount or chin-up bar secured to the header or top of a door opening, or the like) such that the exercise equipment may be pulled (e.g., lifted) toward the pulley 714 via movement of the cable handle 708 (e.g., by pulling the cable handle 708 away from the pulley 714). For example, by applying a pulling force to the cable handle 708, tension may be applied to the length of the cable 704 and directed via the pulley 714 to the clamp 100 and ultimately to the exercise equipment. In the illustrated implementation, the clamp 100 is secured in the closed configuration via the collar 112.

Figure 8:
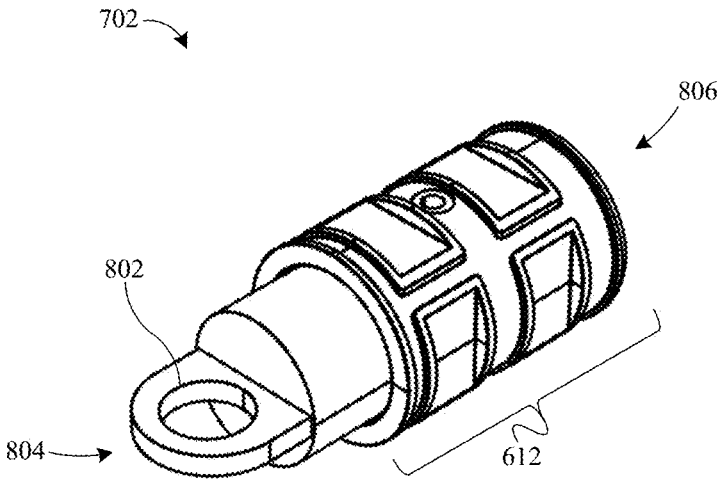
FIG. 8 is a perspective view illustration of a portion of the external handle of FIG. 7.

Referring to FIG. 8, an example of the cable connector 702 of the external handle 200 is shown. The cable connector 702 of the external handle 200 may include a connecting feature 802 for connecting the cable connector 702 to the cable 704 (e.g., the first end 706 of the cable 704). In some implementations, the connecting feature 802 may be or comprise an aperture that is configured to receive a hook located at the first end 706 of the cable 704. In some implementations, the hook may comprise a carabiner clip.

The connecting feature 802 may be located at a first end 804 of the cable connector 702 of the external handle 200 and the end 612 of the external handle 200 may be located at a second end 806 of the cable connector 702 that is opposite the first end 804. Accordingly, when the external handle 200 is connected to the clamp 100, the end 612 may be received within the second cavity 610 of the clamp 100 while the connecting feature 802 extends out of the second cavity 610. In some implementations, the connecting feature 802 may be omitted and the cable 704 may be fixedly secured to the cable connector 702 (e.g., may be formed with the cable connector 702).

Figure 9:
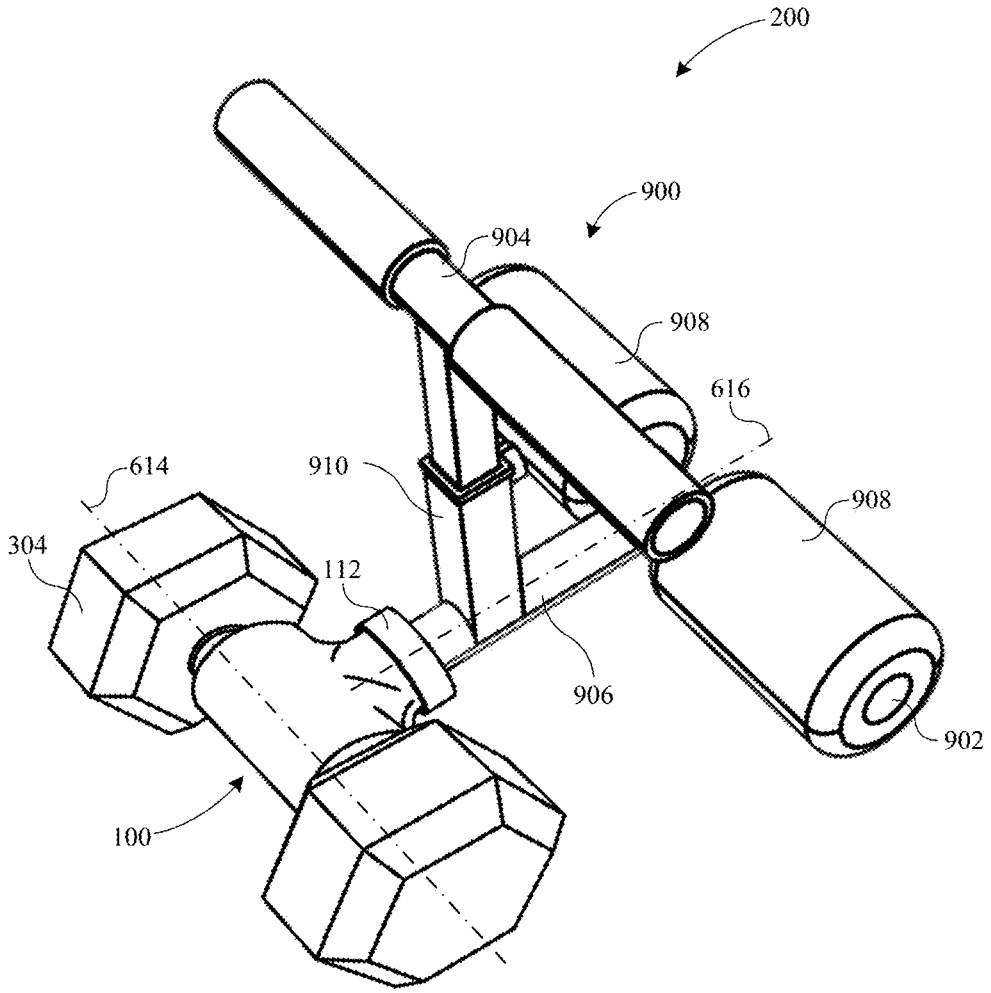
FIG. 9 is a perspective view illustration of another example of an external handle in combination with a clamp and a dumbbell.

FIG. 9 shows the clamp 100 connecting exercise equipment to an example of the external handle 200 that comprises a tib-bar system 900. In the illustrated implementation, the exercise equipment is a dumbbell. The tib-bar system 900 may comprise a first bar 902 and a second bar 904. The first bar 902 and the second bar 904 may each be configured to extend parallel with the first axis 614 of the clamp 100 when the external handle 200 is connected to the clamp 100 (e.g., when the end 612 of the external handle 200 is received by the second cavity 610). The first bar 902 may be connected to the end 612 of the external handle 200 via a first connecting member 906 that extends generally along the second axis 616 of the clamp 100 from the end 612 to a medial location of the first bar 902. Furthermore, the first bar 902 may include pads 908 that extend concentrically around the first bar 902. In some implementations, the first bar 902 may include two of the pads 908, in which each of the pads 908 extends concentrically around separate portions of the first bar 902 (e.g., portions of the first bar 902 that extend away from the first connecting member 906). The pads 908 may comprise foam or some other compliant material.

The second bar 904 may be connected to the first connecting member 906 via a second connecting member 910 that extends away from the first connecting member 906. In the illustrated implementation, the second connecting member 910 extends perpendicularly away from the first connecting member 906 from a medial location along the first connecting member 906. In other implementations, the second connecting member 910 may extend away from the first connecting member 906 at some other angle. The second connecting member 910 may extend from the first connecting member 906 at any location along the first connecting member 906 (e.g., at a location toward the first bar 902 or at a location toward the end 612).

The tib-bar system 900 gets its name from the tibialis anterior muscle of the human leg, which extends generally from the knee to the angle along the front (e.g., anterior) side of the leg. The tib-bar system 900 may enable a person to strengthen their tibialis anterior muscle by placing the ball or heel of the person's feet on top of the second bar 904 and extending the foot (e.g., the front part of the foot and/or toes) below the first bar 902. By flexing the tibialis anterior muscle, the user may pull the first bar 902 in an upward arc motion about the second bar 904. Because the first bar 902 is fixed relative to the exercise equipment via the clamp 100, the exercise equipment may provide resistance to the upward arc motion and thereby encourage strengthening of the tibialis anterior muscles. In the illustrated implementation, the clamp 100 is secured in the closed configuration via the collar 112.

Figure 10:
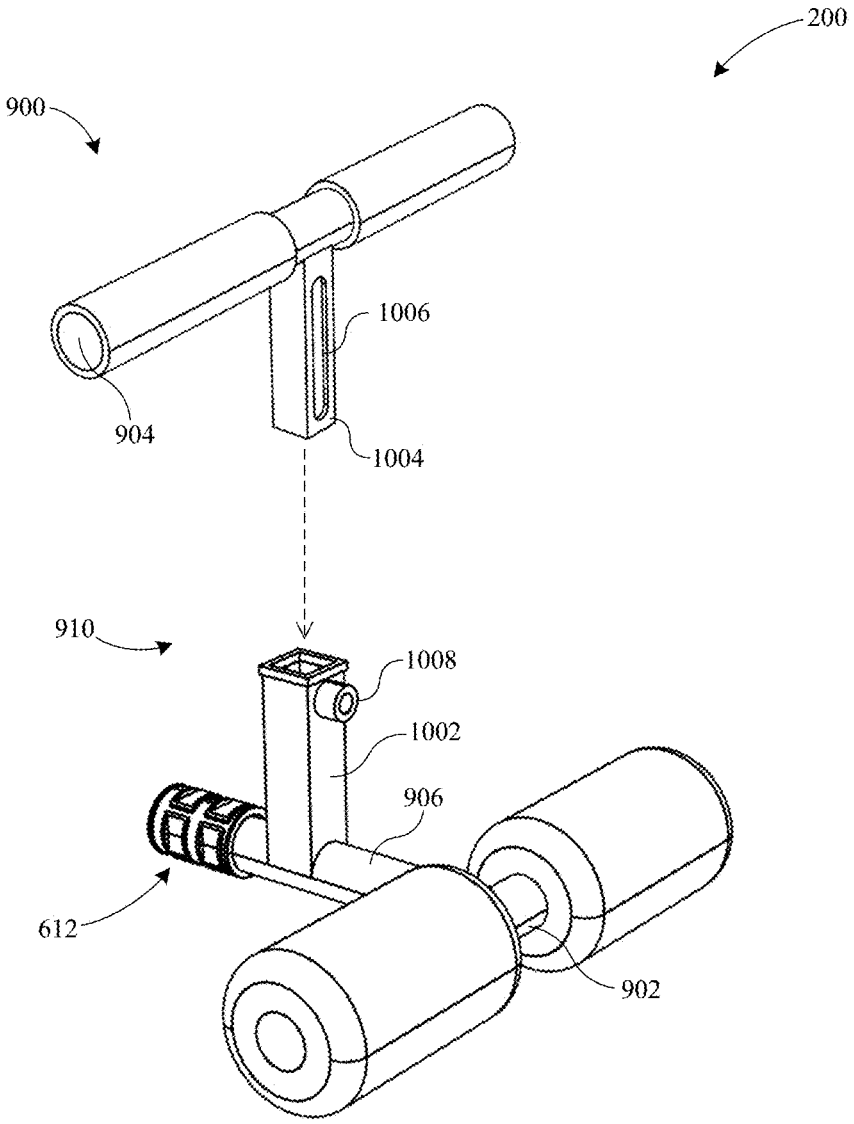
FIG. 10 is an exploded view illustration of the external handle of FIG. 9.

Referring to FIG. 10, an example of the external handle 200 having the tib-bar system 900 is shown. The second connecting member 910 may be adjustable (e.g., may have an adjustable length) such that the second bar 904 may be moved toward and away from the first connecting member 906. As shown, the second connecting member 910 includes a first telescoping portion 1002 and a second telescoping portion 1004. The first telescoping portion 1002 is fixedly secured to the first connecting member 906 and is configured to receive the second telescoping portion 1004. The second telescoping portion 1004 is fixedly secured to the second bar 904 and is configured to slide (e.g., translate) within the first telescoping portion 1002.

In some implementations, the second connecting member 910 may include a detent such that a user may selectively adjust the length of the second connecting member 910. Stated differently, the first telescoping portion 1002 and the second telescoping portion 1004 may cooperatively define a detent that enables the user to selectively move the second telescoping portion 1004 relative to the first telescoping portion 1002. In the illustrated implementation, for example, the second telescoping portion 1004 includes a slot 1006 and the first telescoping portion 1002 includes a tightening device 1008. When the second telescoping portion 1004 is received by the first telescoping portion 1002, the tightening device 1008 may interface with (e.g., may extend into) the slot 1006 and may be configured to be tightened to inhibit (e.g., prevent) movement of the second telescoping portion 1004 relative to the first telescoping portion 1002. To adjust the length of the second connecting member 910, the user may disengage (e.g., loosen) the tightening device 1008 to allow movement of the second telescoping portion 1004 relative to the first telescoping portion 1002. The tightening device 1008 may thereafter be engaged (e.g., tightened) to inhibit (e.g., prevent) the second telescoping portion 1004 from moving relative to the first telescoping portion 1002.

As another example, the second telescoping portion 1004 may include a series of apertures (not shown), and the first telescoping portion 1002 may include a spring-loaded protrusion (not shown) that is configured to be received by each of the apertures to inhibit (e.g., prevent) inadvertent movement of the second telescoping portion 1004 relative to the first telescoping portion 1002. To adjust the length of the second connecting member 910, the user may depress the spring-loaded protrusion to allow movement of the second telescoping portion 1004 relative to the first telescoping portion 1002. The spring-loaded protrusion may thereafter extend into another of the apertures to inhibit (e.g., prevent) inadvertent movement of the second telescoping portion 1004 relative to the first telescoping portion 1002.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise system comprising:

a cable connector comprising an aperture configured to engage a corresponding attachment of a cable; and a clamp having an open configuration and a closed configuration, the clamp including a first portion and a second portion that cooperatively define a first cavity that extends along a first axis and a second cavity that extends along a second axis that is perpendicular to the first axis, wherein, when the clamp is in the open configuration, the first cavity is configured to receive a portion of exercise equipment and the second cavity is configured to receive a portion of the cable connector, and wherein, when the clamp is in the closed configuration, the first portion and the second portion are configured to cooperatively extend around the portion of the cable connector to secure the cable connector relative to the exercise equipment.

2. The exercise system of claim 1, wherein the aperture is located at a first end of the cable connector that is opposite a second end, and wherein the portion of the cable connector includes the second end of the cable connector.

3. The exercise system of claim 2, wherein, when the clamp is in the closed configuration, the second end of the cable connector is positioned proximate the portion of the exercise equipment and the first end of the cable connector extends out of the second cavity.

4. The exercise system of claim 2, wherein the second cavity includes a geometric feature and the cable connector includes a corresponding geometric feature that is configured to interface with the geometric feature of the second cavity to inhibit relative movement between the cable connector and the clamp.

5. The exercise system of claim 1, wherein the first portion and the second portion are pivotally connected to define the open configuration and the closed configuration.

6. The exercise system of claim 5, further comprising:

a fastener that releasably secures the clamp in the closed configuration.

7. The exercise system of claim 1, further comprising:

the cable, wherein the cable includes a handle at a first end of the cable, and wherein the corresponding attachment of the cable is located at a second end of the cable that is opposite the first end of the cable.

8. The exercise system of claim 7, further comprising:

a pulley that interfaces with a length of the cable that extends between the first end and the second end.

9. The exercise system of claim 1, wherein the portion of the exercise equipment is a handle of the exercise equipment.

10. An exercise system comprising:

a clamp comprising:

a first portion having a first body cavity and a first neck cavity;

a second portion having a second body cavity and a second neck cavity; and a hinge rotatably connecting the first portion and the second portion to define an open configuration and a closed configuration; and a cable connector comprising an aperture that is configured to engage with a corresponding attachment of a cable, wherein when the clamp is in the open configuration:

at least one of the first body cavity or the second body cavity is configured to receive a portion of exercise equipment, and at least one of the first neck cavity or the second neck cavity is configured to receive a portion of the cable connector; and wherein when the clamp is in the closed configuration:

the first body cavity and the second body cavity are configured to cooperatively extend around the portion of the exercise equipment, and the first neck cavity and the second neck cavity are configured to cooperatively extend around the portion of the cable connector to secure the exercise equipment relative to the cable connector.

11. The exercise system of claim 10, wherein when the clamp is in the closed configuration:

the first body cavity and the second body cavity cooperatively form a body cavity that has a generally cylindrical shape extending along a body axis, and the first neck cavity and the second neck cavity cooperatively form a neck cavity that has a generally cylindrical shape extending along a neck axis that is angled relative to the body axis.

12. The exercise system of claim 11, wherein the body axis is perpendicular to the neck axis.

13. The exercise system of claim 11, wherein the portion of the exercise equipment is a handle, and the cable connector is generally cylindrical.

14. The exercise system of claim 10, wherein:

at least one of the first neck cavity or the second neck cavity includes a geometric feature;

the cable connector includes a corresponding geometric feature; and when the clamp is in the closed configuration, the geometric feature engages the corresponding geometric feature to inhibit movement of the cable connector relative to the clamp.

15. The exercise system of claim 14, wherein when the clamp is in the closed configuration:

the first neck cavity and the second neck cavity cooperatively form a neck cavity that extends along a neck axis; and the geometric feature engages the corresponding geometric feature to inhibit translational movement of the cable connector along the neck axis relative to the clamp.

16. An exercise system comprising:

a clamp comprising a first clamshell portion defining a first portion of a first cavity and a first portion of a second cavity, wherein the first cavity extends along a first axis and the second cavity extends along a second axis that is perpendicular to the first axis, and a second clamshell portion pivotably connected to the first clamshell portion to enable the first clamshell portion to selectively pivot with respect to the second clamshell portion between an open configuration of the clamp and a closed configuration of the clamp, the clamp in the closed configuration corresponding to the first clamshell portion and the second clamshell portion cooperatively defining the first cavity, the first clamshell portion and the second clamshell portion cooperatively defining the second cavity, the second cavity including geometric features spaced from one another to define rotational positions of the clamp relative to an end of an external handle, and the clamp having a T-shape in which the first cavity corresponds to an upper portion of the T-shape and the second cavity corresponds to a stem of the T-shape; and a fastener configured to selectively fix the clamp in the closed configuration and, thereby, support the end of the external handle within the second cavity.

17. The exercise system of claim 16, wherein the second axis perpendicularly intersects the first axis.

18. The exercise system of claim 17, further comprising the external handle, wherein the end of the external handle is a first end, the external handle comprises a bar that extends along the second axis from the first end to a second end opposite the first end, and the first end and the second end are positioned along the second axis.

19. The exercise system of claim 16, wherein the second clamshell portion defines a second portion of the first cavity and a second portion of the second cavity.

20. The exercise system of claim 16, wherein the fastener comprises a collar that simultaneously engages the first clamshell portion and the second clamshell portion and holds the first clamshell portion in the closed configuration with respect to the second clamshell portion.

* * * * *